US007963856B2

(12) United States Patent
Yamamoto

(10) Patent No.: US 7,963,856 B2
(45) Date of Patent: Jun. 21, 2011

(54) GOLF CLUB

(75) Inventor: Akio Yamamoto, Kobe (JP)

(73) Assignee: SRI Sports Limited, Kobe (JP)

( * ) Notice: Subject to any disclaimer, the term of this patent is extended or adjusted under 35 U.S.C. 154(b) by 137 days.

(21) Appl. No.: 12/359,531

(22) Filed: Jan. 26, 2009

(65) Prior Publication Data

US 2009/0275423 A1 Nov. 5, 2009

(30) Foreign Application Priority Data

May 1, 2008 (JP) ..... 2008-119949

(51) Int. Cl.
*A63B 53/02* (2006.01)

(52) U.S. Cl. ..... 473/288; 473/307; 473/309

(58) Field of Classification Search ..... 473/288, 473/307, 309
See application file for complete search history.

(56) References Cited

U.S. PATENT DOCUMENTS 2,848,769 A * 8/1958 Oakley ..... 52/848
3,806,128 A * 4/1974 Endfield ..... 273/290
6,416,415 B1 * 7/2002 Yu ..... 464/42
7,427,239 B2 * 9/2008 Hocknell et al. ..... 473/307
7,465,239 B2 * 12/2008 Hocknell et al. ..... 473/307
7,578,749 B2 * 8/2009 Hocknell et al. ..... 473/288
7,736,243 B2 * 6/2010 Sanchez et al. ..... 473/288
2006/0281575 A1 * 12/2006 Hocknell et al. ..... 473/306
2006/0293115 A1 12/2006 Hocknell et al.
2009/0075748 A1 * 3/2009 Evans et al. ..... 473/306
2009/0239678 A1 * 9/2009 De La Cruz et al. ..... 473/305
2010/0120552 A1 * 5/2010 Sander et al. ..... 473/307

* cited by examiner

*Primary Examiner* — Stephen L. Blau
(74) *Attorney, Agent, or Firm* — Birch, Stewart, Kolasch & Birch, LLP

(57) ABSTRACT

A hosel portion (22) has a screw portion (32) and a hosel hole (28). The screw portion (32) of a screw member (10) and a screw portion (26) of the hosel portion (22) are coupled to each other. An inner member (8) has a shaft inserting hole (40) and a lower surface (42). A shaft (6) and the shaft inserting hole (40) are fixed through bonding or the like. The lower surface (42) of the inner member (8) has a plurality of first surfaces and a plurality of second surfaces. The first surface is a parallel surface with a central axis or a tilted surface which is tilted to a circumferential direction. The first surface is extended in such a direction as to enable, together with a receiving surface, a generation of a force capable of inhibiting a relative rotation of a head and the shaft in hitting. The second surface is extended in a closer direction to the circumferential direction as compared with the first surface. By an engagement of the receiving surface and the lower surface (42), the relative rotation of the shaft (6) and the head (4) is inhibited.

9 Claims, 29 Drawing Sheets

22c (26c)

10c

GOLF CLUB

This application claims priority on Patent Application No. 2008-119949 filed in JAPAN on May 1, 2008, the entire contents of which are hereby incorporated by reference.

BACKGROUND OF THE INVENTION

1. Field of the Invention

The present invention relates to a golf club.

2. Description of the Related Art

In an aspect of a development and sale of a golf club, a performance of a head or a shaft is evaluated. As an evaluating method, hitting is carried out through a tester, a swing robot or the like.

In the case in which the performances of the shafts are to be compared with each other, it is preferable to use the same type of heads to be attached to the shafts. By using the same type of heads, an influence of a difference in the head is lessened so that the performances of the shafts can be accurately compared with each other. For example, in the case in which a comparison test is carried out for three types of shafts, the same type of heads are attached to the three types of shafts respectively to execute the comparison test.

Even if the same type of heads are used, however, a variation in the performance is strictly present in the heads inevitably. In order to compare the performances of the shafts more accurately, it is preferable to sequentially attach the same head to each shaft, thereby carrying out the test.

The comparison test for the performance of the head is also the same as the foregoing. Even if the same type of shaft is attached to each head, a variation in the performance is strictly present in the shafts inevitably. In order to compare the performances of the heads with each other more accurately, it is preferable to sequentially attach the same shaft to each head, thereby carrying out the test.

In the case in which the performances of the head and the shaft are evaluated, accordingly, it is preferable that the head and the shaft should be attached and removed easily.

The easiness of the attachment and removal of the head and the shaft can be useful in various aspects. If the attachment and removal can easily be carried out, a golf player can easily attach the head and the shaft newly by himself (herself). For example, a golf player which cannot satisfy a performance of a purchased golf club can easily attach a head and a shaft newly by himself (herself). Moreover, the golf player himself (herself) can easily assemble an original golf club which is obtained by combining a favorite head with a favorite shaft. The golf player can purchase the favorite head and the favorite shaft and can assemble them by himself (herself). Furthermore, a shop for selling a golf club can select a combination of a head and a shaft which correspond to an aptitude for the golf player and can sell the golf club. A head and a shaft which can easily be attached and removed can cause the golf club to be readily custom-made.

Usually, the head and the shaft are bonded to each other with an adhesive. In order to separate the head and the shaft bonded to each other, it is necessary to pull the shaft from a shaft hole by a strong external force while heating a bonded portion at a high temperature to thermally decompose the adhesive. A labor, equipment and a time are required for the work. Moreover, there is also a possibility that the shaft or the head might be damaged in the heating or pull-out. Usually, the attachment and removal of the head and the shaft cannot be thus carried out easily.

On the other hand, US Patent Application No. US2006/0293115 A1 has disclosed a structure in which an attachment and removal of a head and a shaft can easily be carried out.

SUMMARY OF THE INVENTION

With the structure described in the document, a screw is inserted through a bottom face of a sole and a head and a shaft are fixedly attached to each other with the screw. A special structure having a hole penetrating through a sole face is required for the head. The structure described in the document can be restrictively applied to the head having the special structure and has a low universality. Moreover, the structure described in the document is complicated.

A great impact force is generated in hitting. By the impact force, a hosel portion of the head and the shaft can be relatively rotated. A golf club having a great effect for inhibiting the relative rotation is preferred.

It is an object of the present invention to provide a golf club in which a shaft and a head can easily be attached and removed with a simple structure.

A golf club head according to the present invention includes a shaft, a head, an inner member and a screw member. The head has a hosel portion and a receiving surface. The hosel portion has a screw portion formed on an internal or external surface thereof and a hosel hole. The screw member has a through hole for causing the shaft and the inner member to penetrate therethrough, a screw portion and a downward surface. The screw portion of the screw member and the screw portion of the hosel portion are coupled to each other. The inner member has a central axis, a shaft inserting hole opened toward an upper end side thereof, a lower surface which can be engaged with the receiving surface, and an upward surface. At least a part of the inner member is inserted into the hosel hole. The shaft and the shaft inserting hole are fixed to each other through bonding and/or fitting. The lower surface of the inner member has a rotational symmetry with the central axis of the inner member set to be a rotational symmetrical axis. The lower surface of the inner member has a plurality of first surfaces and a plurality of second surfaces. The first surface and the second surface are alternately disposed in a circumferential direction. The first surface is a parallel surface with the central axis or a tilted surface which is tilted to the circumferential direction. The first surface is extended in such a direction as to enable, together with the receiving surface, a generation of a force capable of inhibiting a relative rotation of the inner member and the hosel hole which might be caused in hitting. The second surface is extended in a closer direction to the circumferential direction as compared with the first surface. The downward surface of the screw member and the upward surface of the inner member are engaged with each other directly or indirectly and the inner member is controlled to be moved upward with respect to the hosel hole by the engagement. The receiving surface and the first surface of the lower surface are engaged with each other directly or indirectly and the relative rotation is controlled by the engagement.

It is preferable that the first surface and the second surface should be divided through an edge line or a valley line and should be continuously disposed each other in the circumferential direction. Preferably, when an angle in the circumferential direction which is defined by the edge lines having the closest relationship in the circumferential direction is set to be $\theta$ (degree) and an angle in the circumferential direction which is defined by the edge line and valley line having the closest relationship in the circumferential direction is set to be $\alpha$ (degree), a ratio $[\alpha/\theta]$ is lower than 0.5.

It is preferable that a distance in a direction of a shaft axis between an outermost point of the edge line and an outermost point of the valley line should be equal to or greater than 1 mm and be equal to or smaller than 4 mm.

By the simple structure, it is possible to provide the golf club in which the head and the shaft can easily be attached and removed.

DESCRIPTION OF THE PREFERRED EMBODIMENTS

The present invention will be described below in detail based on preferred embodiments with reference to the drawings. In the present application, terms indicative of upper and lower parts, for example, "upper end", "upper", "lower end", "lower" and the like are used. In the present application, "upper" implies an upper side in a direction of a shaft axis Z1, that is, a rear end side of a shaft or a grip side of a golf club. Moreover, "lower" implies a lower side in the direction of the shaft axis Z1, that is, a sole side of a head. If there is no particular description, it is assumed that "axial direction" implies the direction of the shaft axis Z1 and "circumferential direction" implies a circumferential direction with respect to the axial direction, and "radial direction" implies a perpendicular direction to the axial direction in the present application.

Figure 1:
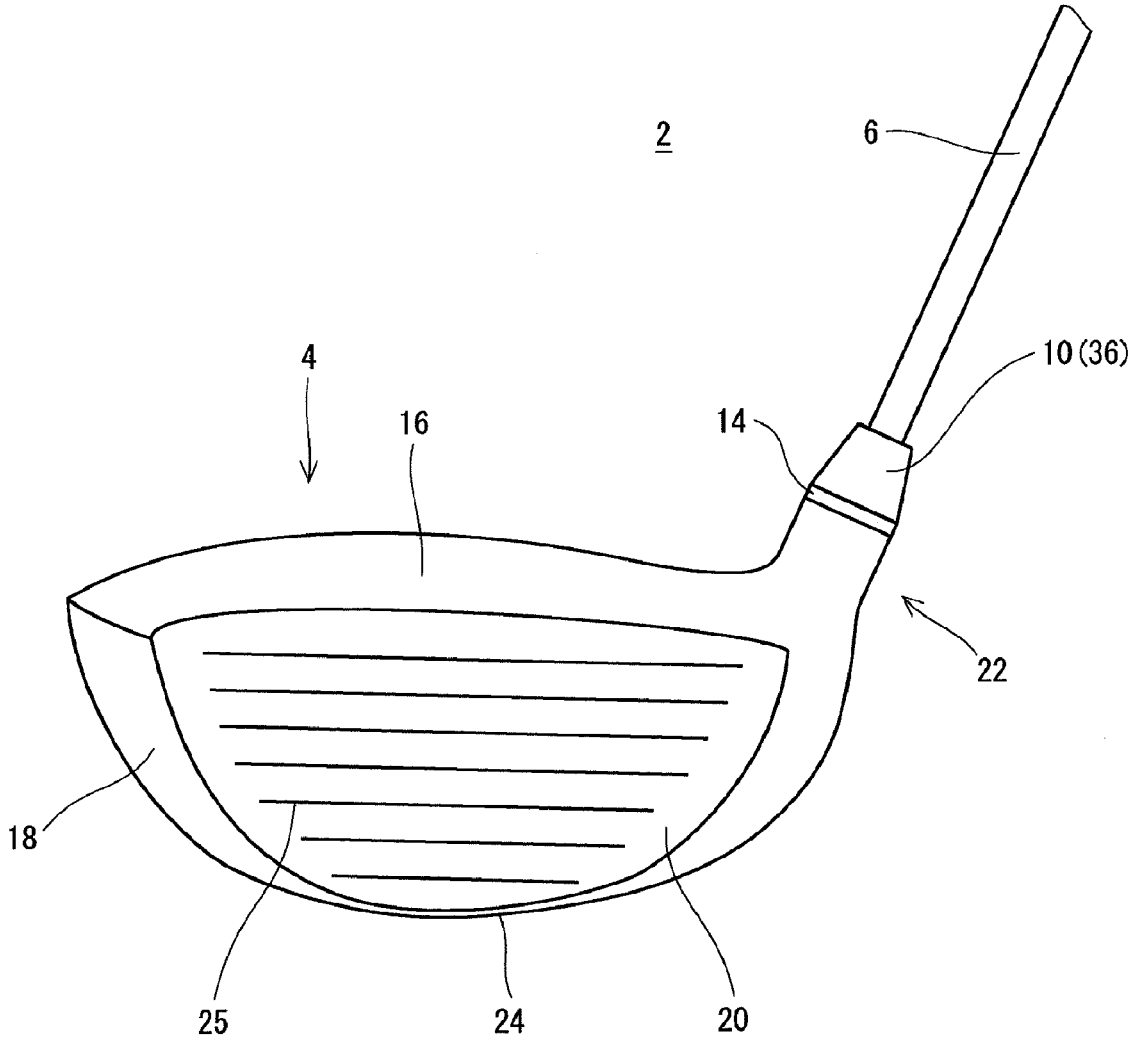
FIG. 1 is a view showing a part of a golf club according to a first embodiment of the present invention.
Figure 2:
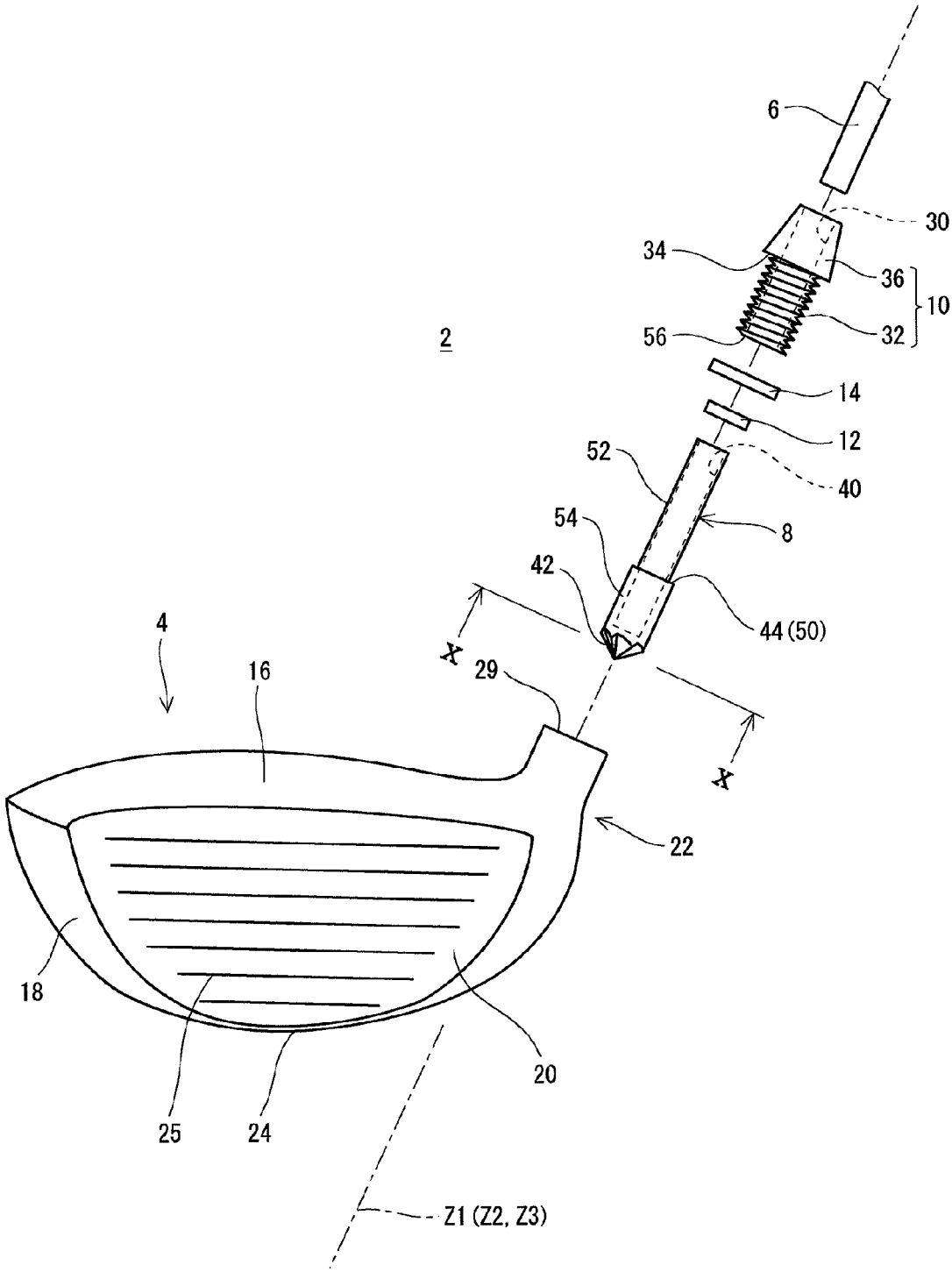
FIG. 2 is an exploded view showing the golf club of FIG. 1.

FIG. 1 is a view showing a part of a golf club 2 according to a first embodiment of the present invention and FIG. 2 is an exploded view showing the golf club 2. The golf club 2 is a right-handed golf club. The golf club 2 has a head 4 and a shaft 6. The head 4 is attached to one of ends of the shaft 6. A grip is attached to the other end of the shaft 6, which is not shown. The shaft 6 takes a tubular shape.

As shown in FIG. 2, the golf club 2 includes an inner member 8, a screw member 10, a washer 12 and a washer 14. The inner member 8, the screw member 10, the washer 12 and the washer 14 are concerned in a bond of the head 4 and the shaft 6.

The head 4 is a golf club head of a wood type. The head 4 has a crown portion 16, a side portion 18, a face portion 20, a hosel portion 22 and a sole portion 24. The head 4 is hollow. The face portion 20 is provided with a face line 25. The head 4 may be a golf club head of an iron type or any other type.

Figure 3:
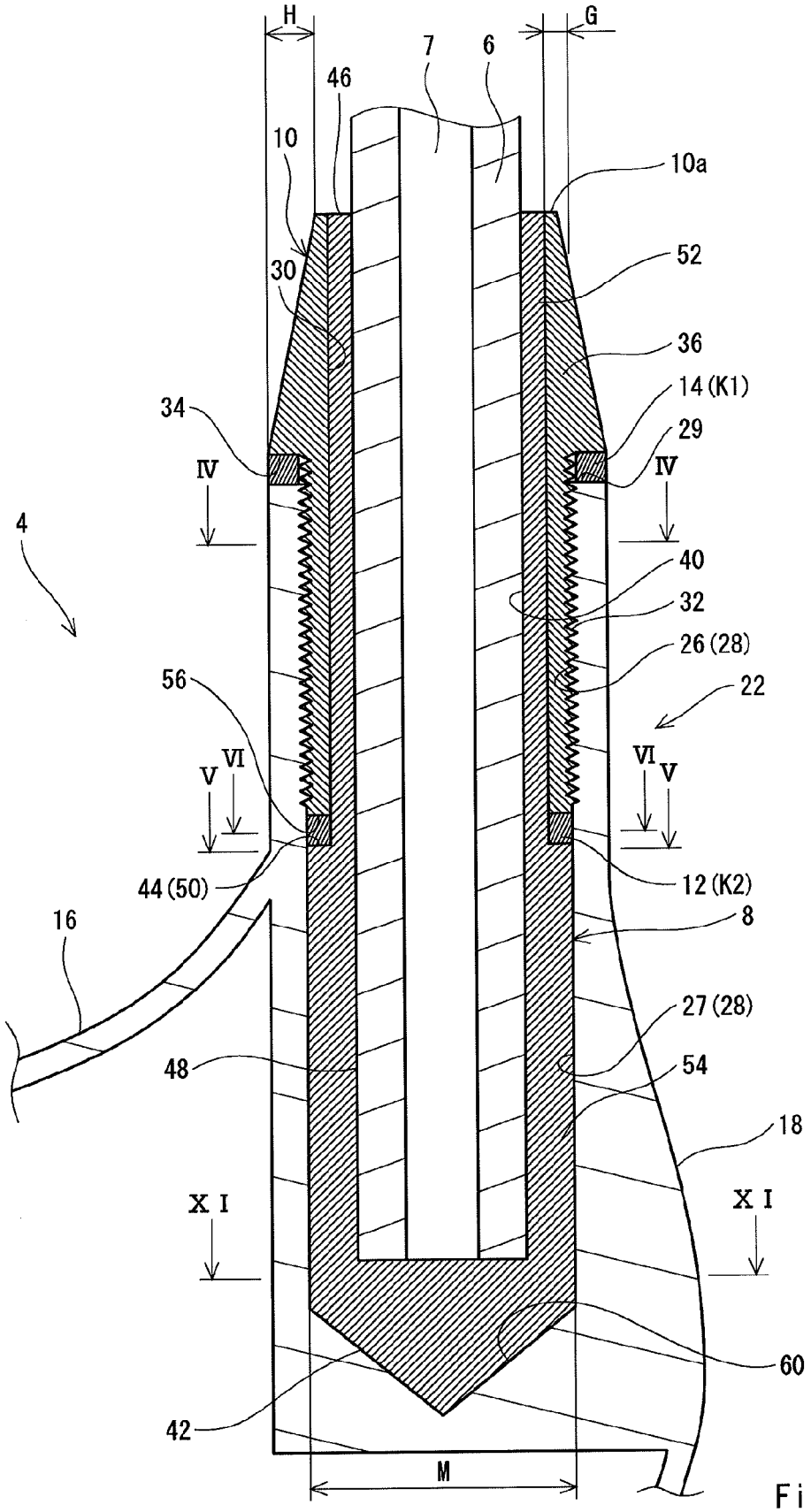
FIG. 3 is a sectional view showing the golf club of FIG. 1, which is taken along a shaft axis.
Figure 4:
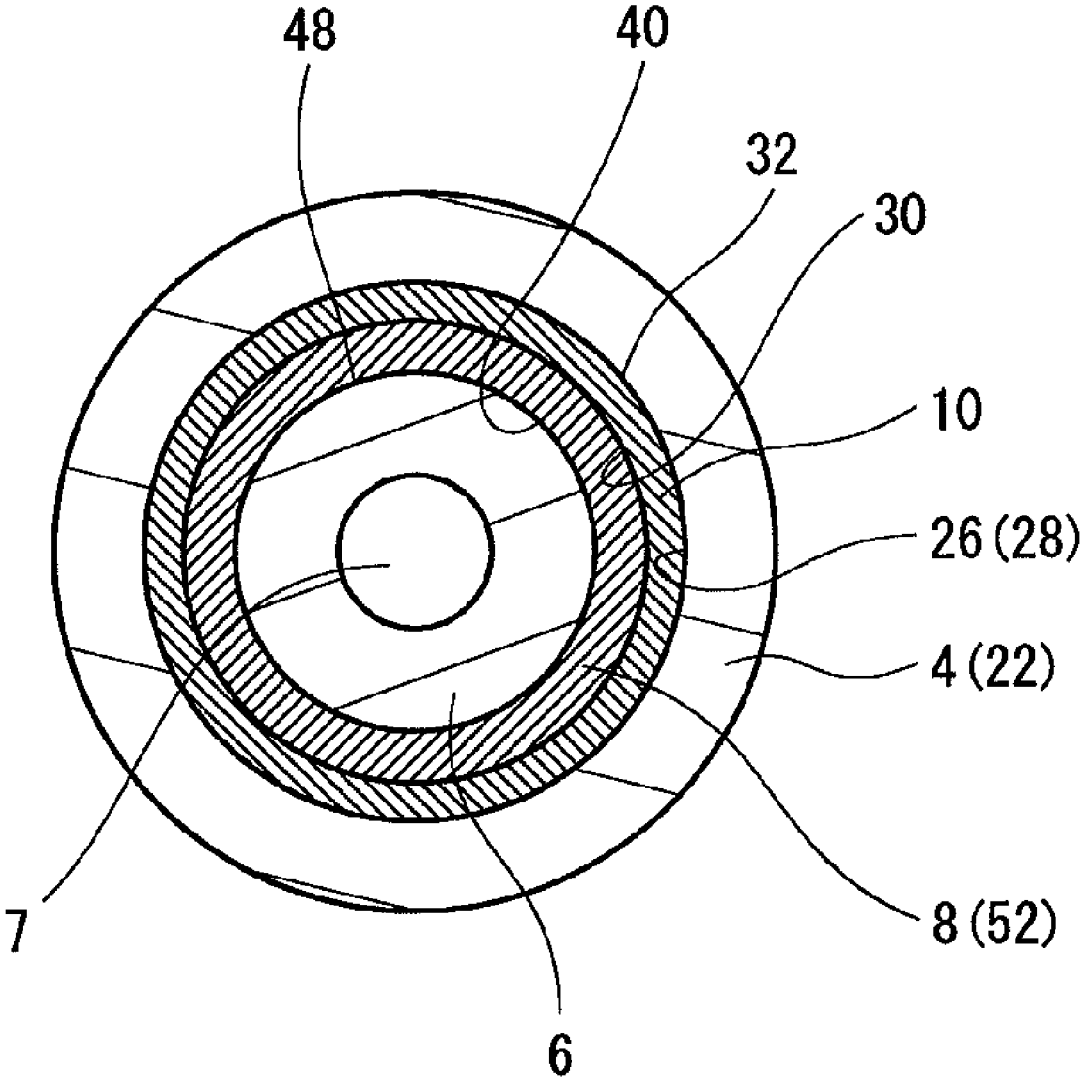
FIG. 4 is a sectional view showing the golf club taken along an IV-IV line in FIG. 3.
Figure 5:
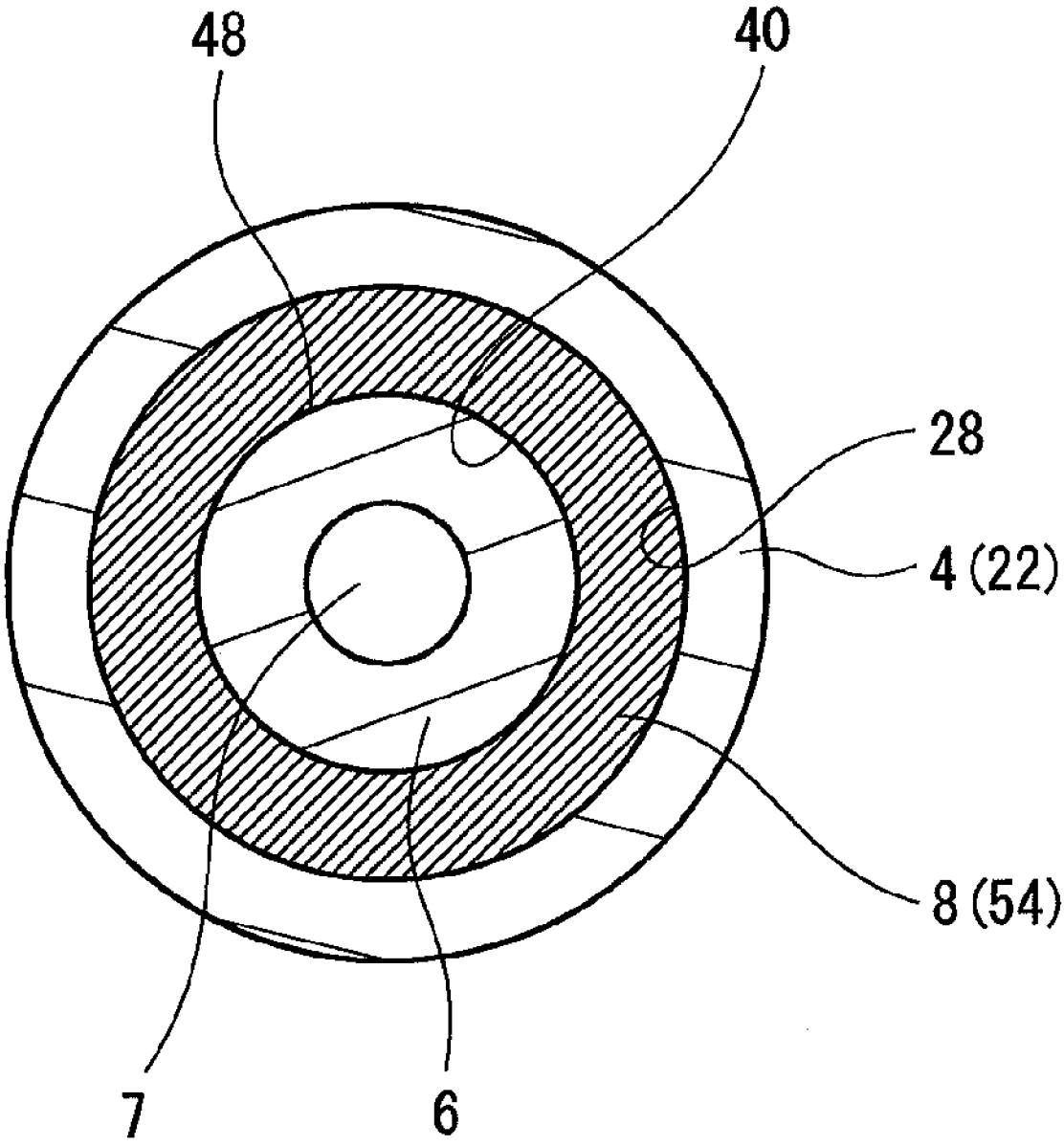
FIG. 5 is a sectional view showing the golf club taken along a V-V line in FIG. 3.
Figure 6:
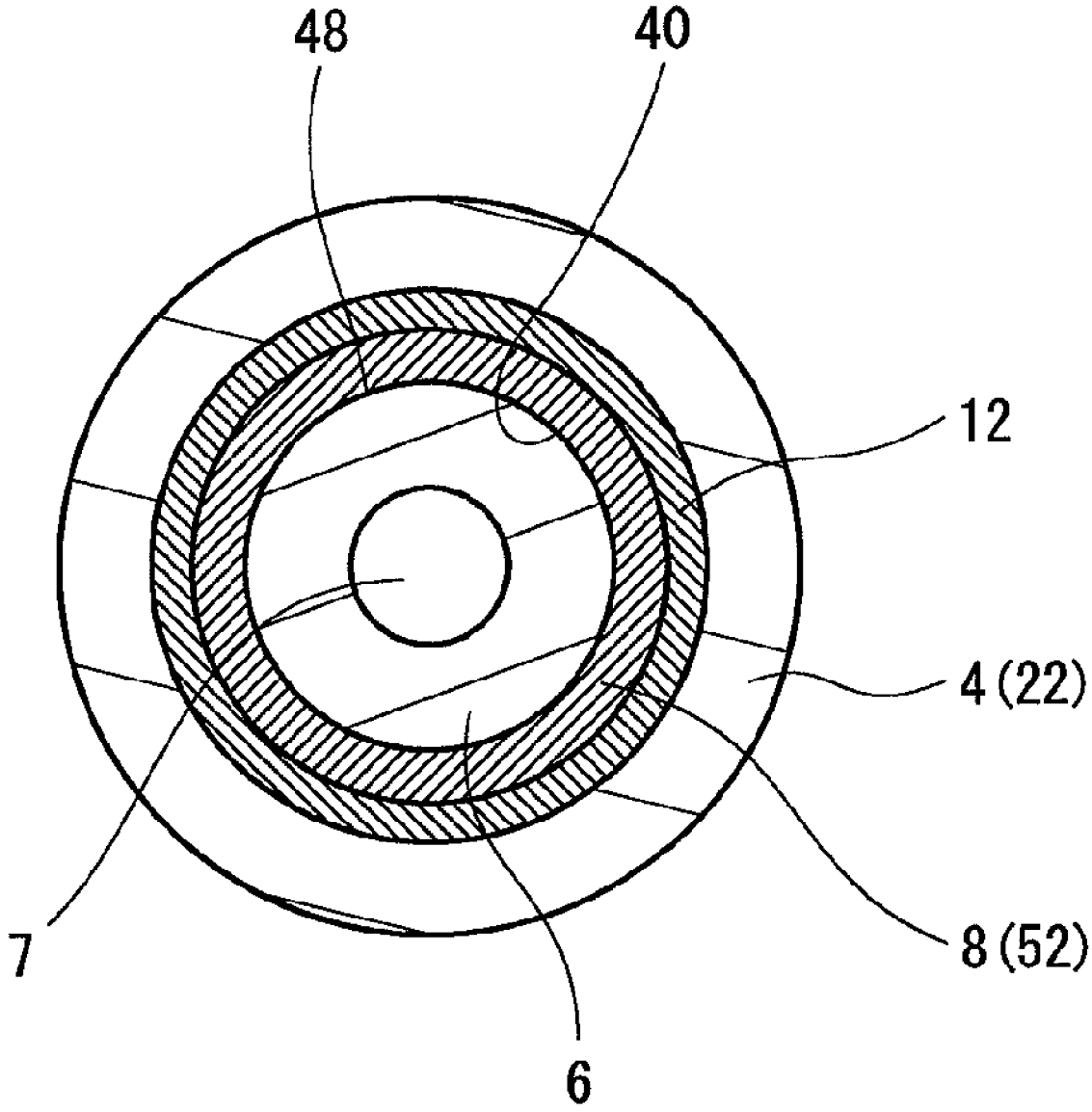
FIG. 6 is a sectional view taken along a VI-VI line in FIG. 3.

FIG. 3 is a sectional view showing the vicinity of the hosel portion 22. FIG. 3 is a sectional view taken along a plane including the shaft axis Z1. FIG. 4 is a sectional view showing the golf club 2 taken along an IV-IV line in FIG. 3. FIG. 5 is a sectional view showing the golf club 2 taken along a V-V line in FIG. 3. FIG. 6 is a sectional view showing the golf club 2 taken along a VI-VI line in FIG. 3. For easy understanding of the drawings, a sectional shape of a screw portion is not taken into consideration in FIGS. 4, 5 and 6.

The shaft 6 has a hollow portion 7. The hosel portion 22 has a screw portion 26 formed on an internal surface thereof and a hosel hole 28. The screw portion 26 constitutes a part of the hosel hole 28. The hosel hole 28 has a screw portion 26 and a non-screw portion 27. The non-screw portion 27 is positioned on a lower side of the screw portion 26. A surface of the non-screw portion 27 is a smooth circumferential surface. As shown in FIG. 3, the screw portion 26 is a female screw. The screw portion 26 is formed in an upper part of the hosel hole 28. The screw portion 26 is provided from an end face 29 of the hosel portion 22 to a middle position of the hosel hole 28.

The screw member 10 has a through hole 30, a screw portion 32, and downward surfaces 34 and 56 (see FIGS. 2 and 3). Furthermore, the screw member 10 has an exposed portion 36. The through hole 30 penetrates the screw portion 32 and the exposed portion 36. A lower part of the screw member 10 is set to be the screw portion 32. The screw portion 32 constitutes a part of an external surface of the screw member 10. The screw portion 32 is a male screw. An internal surface of the screw portion 32 serves as the through hole 30. An upper part of the screw member 10 is set to be the exposed portion 36. The screw portion 32 is not visually recognized from an outside. In the golf club 2, the exposed portion 36 is exposed to the outside. An internal surface of the exposed portion 36 serves as the through hole 30.

The downward surface 34 is positioned on a boundary between the screw portion 32 and the exposed portion 36. The downward surface 34 is a step surface. The downward surface 34 is a plane. The downward surface 34 takes an annular shape. The downward surface 34 is extended in a radial direction. An outside diameter of the downward surface 34 is larger than an outside diameter (a maximum diameter) of the screw portion 32. In the screw member 10, the outside diameter of the downward surface 34 is larger than a maximum diameter in a portion provided under the downward surface 34. The downward surface 34 is extended outward in the radial direction from the screw portion 32. The downward surface 34 may be tilted to the radial direction. The downward surface can receive an upward force.

An external surface of the exposed portion 36 forms a conical surface (a conical projection surface). An outside diameter of the exposed portion 36 is increased toward a lower side. The exposed portion 36 has a maximum outside diameter at a lower end thereof. The maximum diameter of the exposed portion 36 is substantially equal to an outside diameter of the end face 29 of the hosel portion 22.

In an appearance, the exposed portion 36 looks like a so-called ferrule. The golf club usually has the ferrule. The appearance of the exposed portion 36 is the same as that of the ferrule. The golf club 2 has the same appearance as that of an ordinary golf club. A large number of golf players that are familiar with the ordinary golf club do not feel uncomfortable in the appearance of the golf club 2.

The through hole 30 penetrates the screw member 10. The through hole 30 and the screw member 10 are coaxial with each other. The screw member 10 and the shaft 6 are disposed coaxially. The screw member 10 and the inner member 8 are disposed coaxially.

The washer 14 takes an annular shape. The washer 14 is provided between the end face 29 of the hosel portion 22 and the downward surface 34. An outside diameter of the washer 14 is substantially equal to the outside diameter of the end face 29 of the hosel portion 22. The outside diameter of the washer 14 is substantially equal to the outside diameter of the downward surface 34. In an appearance, the washer 14 easily seems to be integral with the hosel portion 22 or the exposed portion 36. A large number of golf players that are familiar with an ordinary golf club do not feel uncomfortable in the appearance of the washer 14 and the hosel portion 22. It is preferable that a color of an external surface of the washer 14 should be the same as a color of the external surface of the hosel portion 22 or the exposed portion 36. For example, the external surface of the exposed portion 36 and the washer 14 may have a black color. The washer 14 may be eliminated. In the case in which the washer 14 is not provided, the appearance of the golf club 2 is substantially identical to an appearance of the ordinary golf club, resulting in no uncomfortable feeling.

As shown in FIG. 3, the screw portion 32 of the screw member 10 and the screw portion 26 of the hosel portion 22 are coupled to each other. More specifically, the screw portion 32 to be the male screw and the screw portion 26 to be the female screw are coupled to each other. Through the screw coupling, the screw member 10 is fixed to the head 4.

The screw coupling is constituted to carry out tightening by a force received from a ball in hitting. The head 4 is right-handed. In case of the right-handed head 4, the head 4 tries to be rotated clockwise around the shaft axis Z1 as seen from above (the grip side) by the force received from the ball in the hitting. By the rotation, the screw portion 26 (the female screw) and the screw portion 32 (the male screw) are tightened. When the screw member 10 is rotated counterclockwise as seen from above (the grip side), the screw portion 26 and the screw portion 32 are tightened. To the contrary, when the screw member 10 is rotated clockwise as seen from above (the grip side), the tightening of the screw portions 26 and 32 is loosened. Thus, the screw portions 26 and 32 are left-hand screws.

In case of the right-handed golf club, thus, it is preferable that the screw portions 26 and 32 should be set to be the left-hand screws. By setting them to be the left-hand screws, the screw coupling can be prevented from being loosened due to an impact in the hitting. In order to prevent the screw coupling from being loosened due to the impact in the hitting, it is preferable that the screw portions 26 and 32 should be right-hand screws in case of the left-handed golf club.

Figure 7:
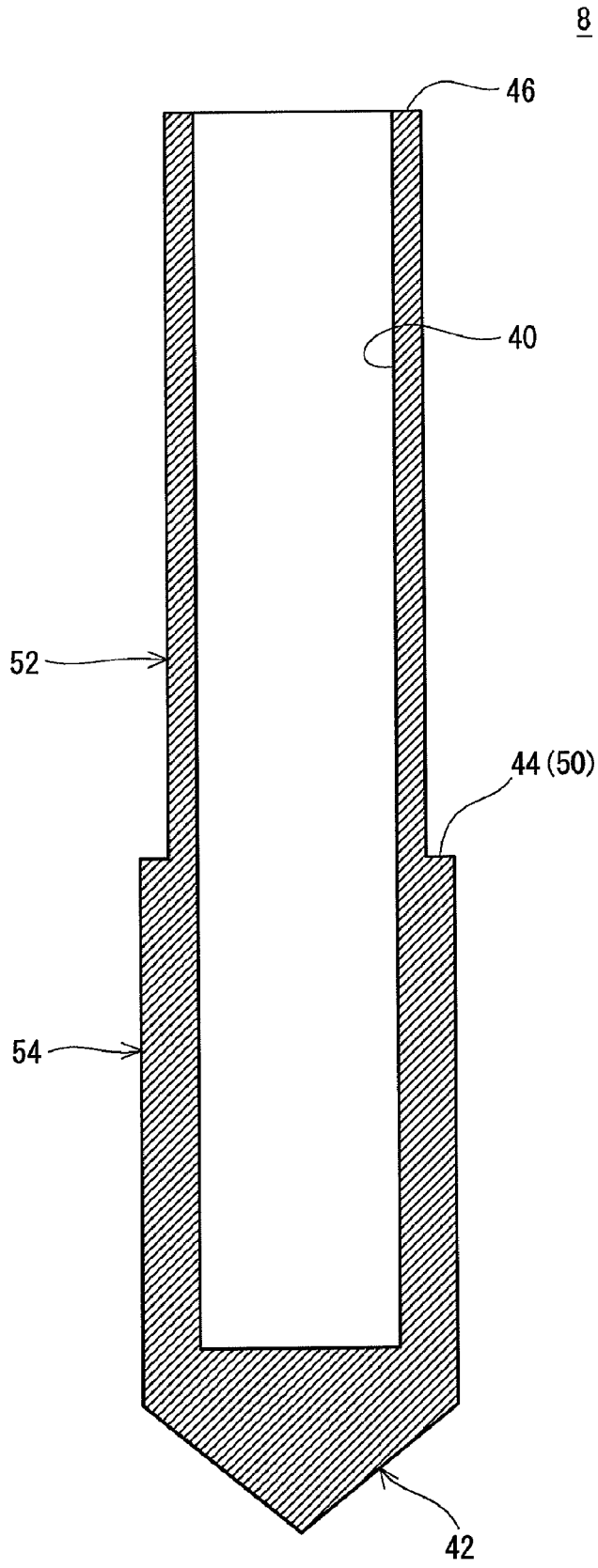
FIG. 7 is a sectional view showing an inner member.
Figure 8:
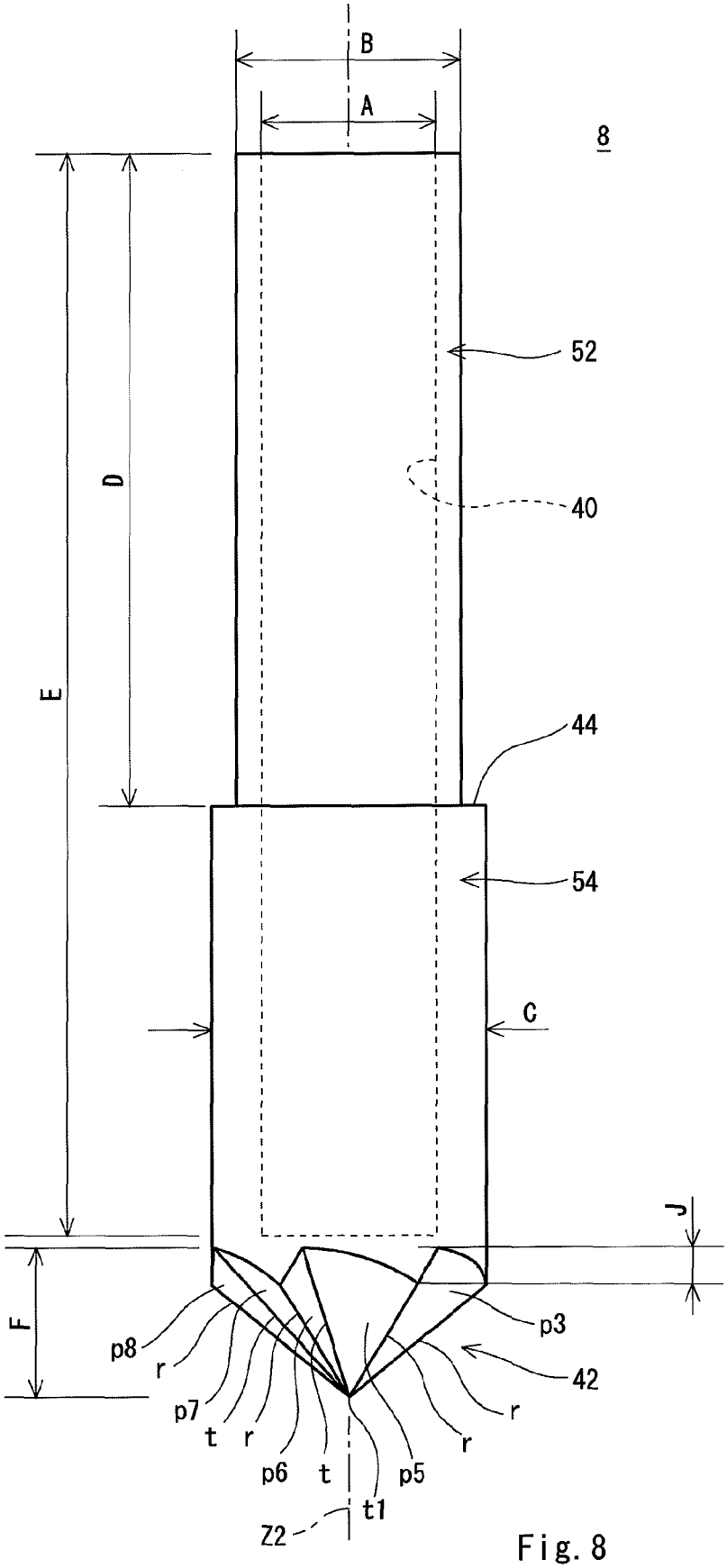
FIG. 8 is a side view showing the inner member.
Figure 9:
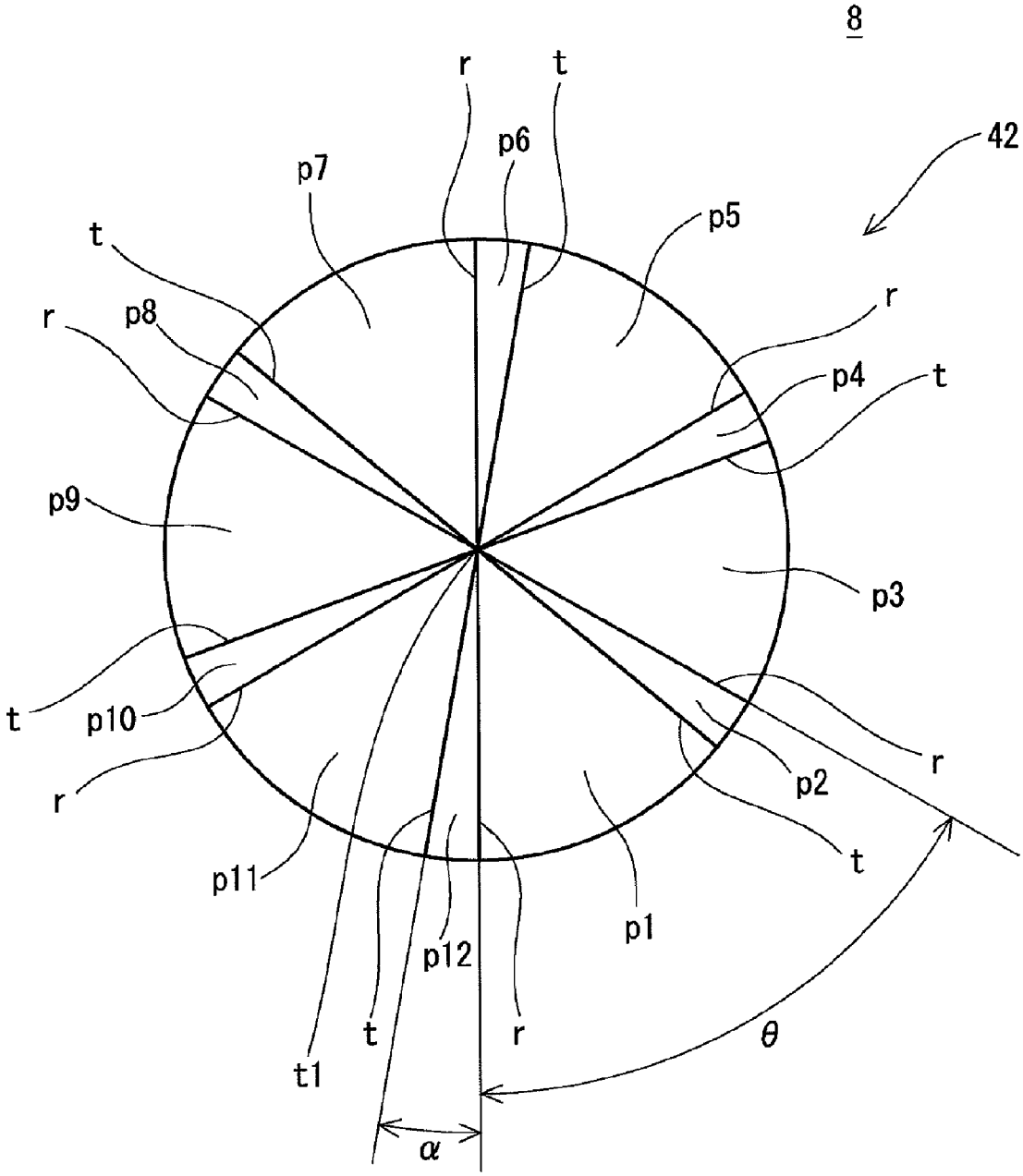
FIG. 9 is a plan view showing the inner member seen from below.
Figure 10:
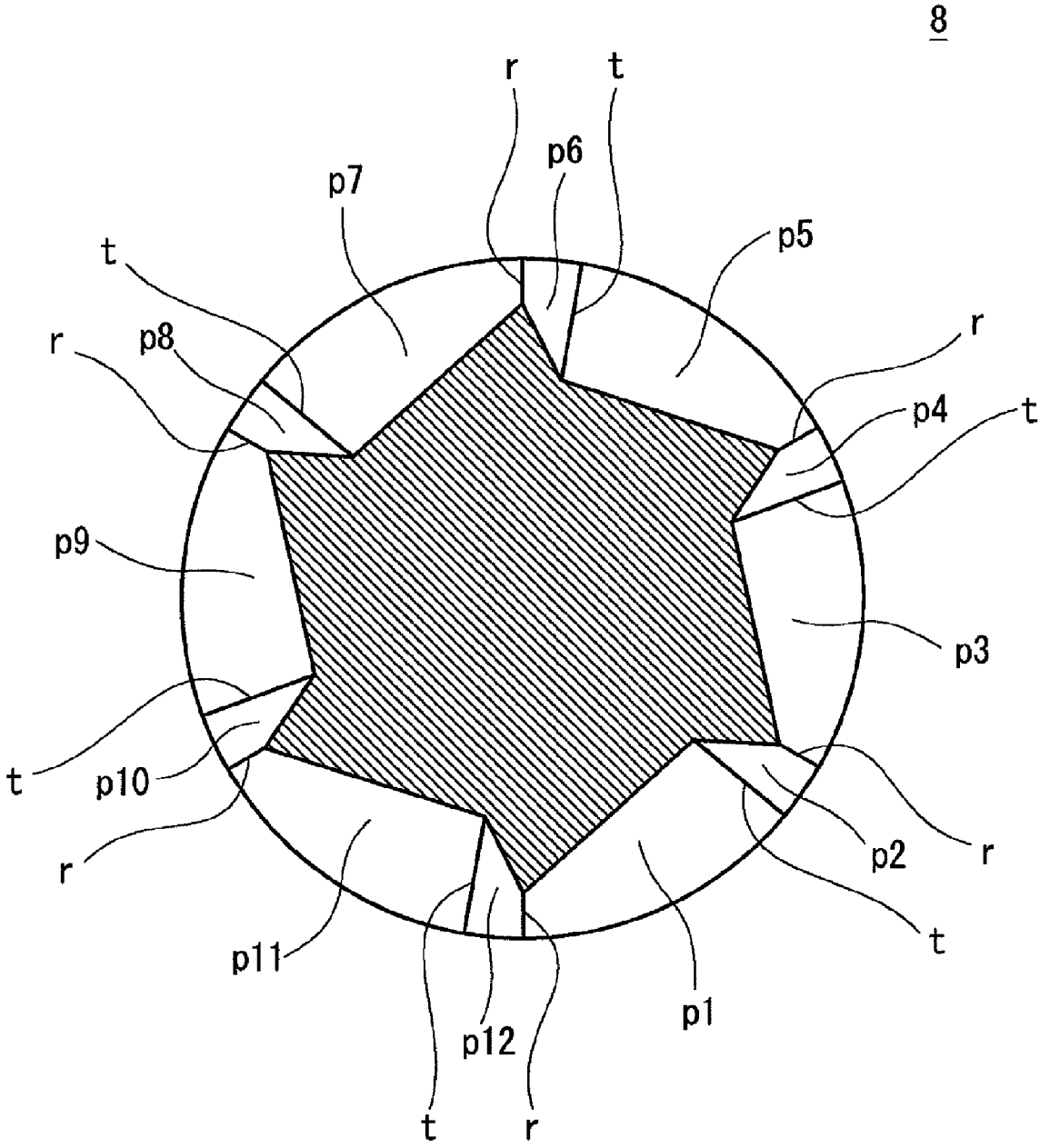
FIG. 10 is a sectional view showing the inner member taken along an X-X line in FIG. 2.
Figure 11:
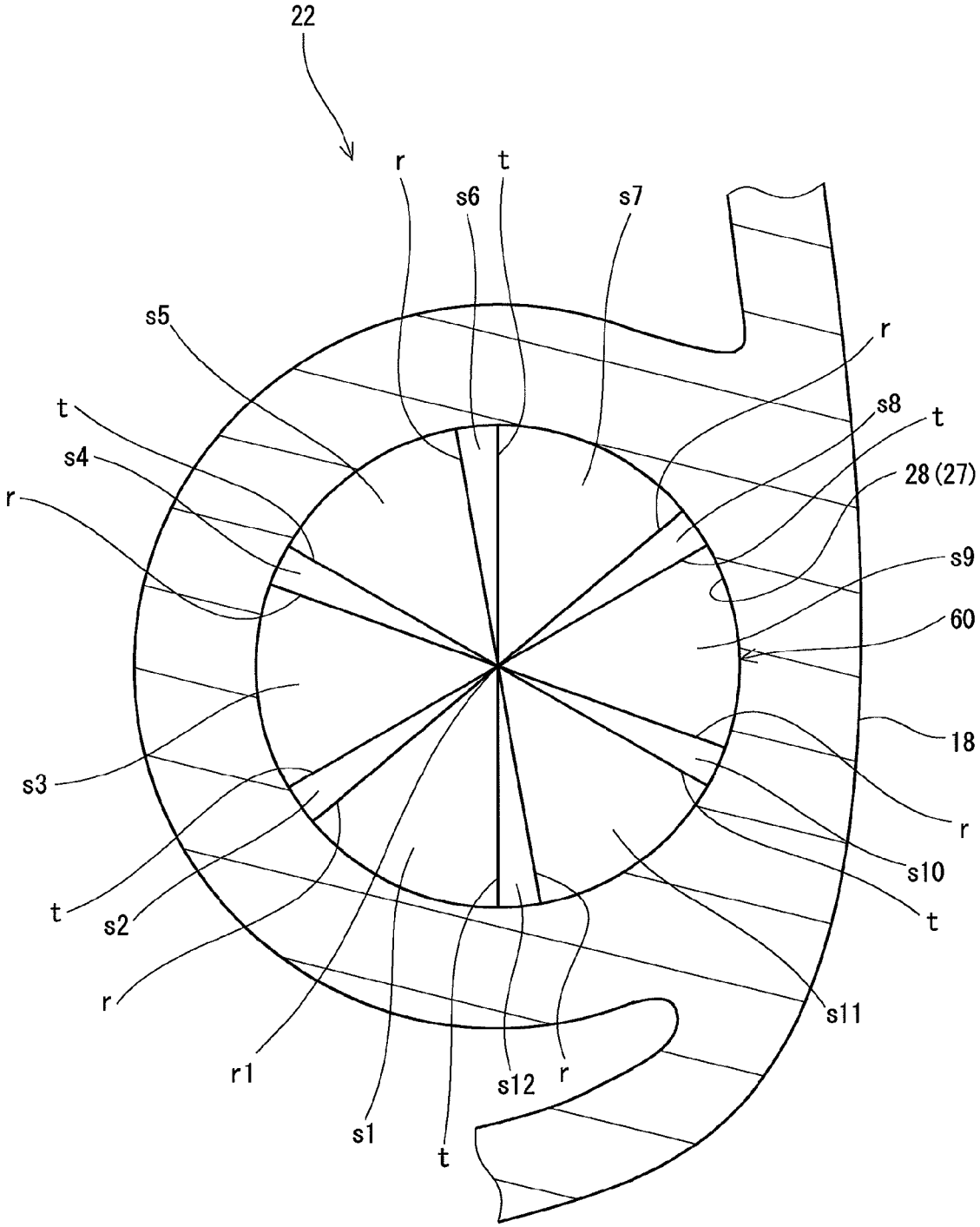
FIG. 11 is a sectional view showing a hosel portion taken along an XI-XI line in FIG. 3.

FIG. 7 is a sectional view showing the inner member 8. FIG. 7 is a sectional view taken along a plane including the shaft axis Z1. FIG. 8 is a side view showing the inner member 8. FIG. 9 is a plan view showing the inner member 8 seen from below. FIG. 10 is a sectional view showing the inner member 8 taken along an X-X line in FIG. 2. FIG. 11 is a sectional view showing the hosel portion 22 taken along an XI-XI line in FIG. 3.

The inner member 8 has a part inserted in the hosel hole 28. As shown in FIG. 3, a lower part of the inner member 8 is inserted in the hosel hole 28. A portion of the inner member 8 which is not inserted in the hosel hole 28 is positioned on an inside of the exposed portion 36 in the screw member 10 and an inside of the washer 14.

As shown in FIG. 7 and the like, the inner member 8 has a shaft inserting hole 40, a lower surface 42 and an upward surface 44. The shaft inserting hole 40 is opened toward an upper end side of the inner member 8. The shaft inserting hole 40 is opened at an upper end face 46 of the inner member 8.

The inner member 8 is fixed to the shaft 6. The inner member 8 is bonded to the shaft 6. The inner member 8 is bonded to the shaft 6 with an adhesive. The shaft inserting hole 40 is bonded to an external surface 48 of the shaft 6. In the sectional views of the present application, an adhesive layer is not shown. The inner member 8 and the shaft 6 may be fixed by a method other than the adhesive (adhesive agent). Examples of the fixing method include fitting. In respect of a productivity and a fixing strength, the bonding through the adhesive is preferable.

The upward surface 44 is disposed in a middle position in a longitudinal direction of the inner member 8. An outside diameter of an upper part (a small diameter portion 52) of the inner member 8 is smaller than an outside diameter of a lower part (a large diameter portion 54) of the inner member 8. Due to a difference in the outside diameter, a step surface 50 is provided. The step surface 50 serves as the upward surface 44. The upward surface 44 takes an annular shape. The upward surface 44 is extended in the radial direction. An inside diameter of the upward surface 44 is equal to the outside diameter of the small diameter portion 52. An outside diameter of the upward surface 44 is equal to the outside diameter of the large diameter portion 54. The upward surface 44 may be tilted to the radial direction. Moreover, the position of the upward surface 44 is not restricted. The upward surface 44 does not need to take the annular shape. For example, the upward surface 44 may be an upper surface of a projection portion. The upward surface can receive a downward force.

The outside diameter of the large diameter portion 54 is almost equal to a diameter of the non-screw portion 27 in the hosel hole 28. The outside diameter of the small diameter portion 52 is almost equal to a diameter of the through hole 30. A clearance is not substantially present between the inner member 8 and the hosel hole 28.

As shown in FIG. 3, the washer 12 is provided between the upward surface 44 and the screw member 10. The washer 12 is provided between the lower end face 56 of the screw member 10 and the upward surface 44. The lower end face 56 is a downward surface. The washer 12 can prevent the upward surface 44 and the downward surface 56 from being worn out. The washer 12 does not need to be provided.

The downward surface 56 takes an annular shape. The downward surface 56 is extended in the radial direction. The downward surface 56 serves as a lower end face of the screw portion 32. The downward surface 56 may be tilted to the radial direction. The downward surface can receive an upward force.

The lower surface 42 wholly takes a tapered shape. The lower surface 42 of the inner member 8 is a recess and projection surface. As shown in FIGS. 8, 9 and 10, the lower surface 42 is constituted by a plurality of surfaces. The lower surface 42 is constituted by a plurality of planes. The lower surface 42 is constituted by 12 planes. The lower surface 42 is constituted by planes p1, p2, p3, p4, p5, p6, p7, p8, p9, p10, p11 and p12 (see FIGS. 9 and 10). The planes p2, p4, p6, p8, p10 and p12 will be referred to as first surfaces in the present application. The planes p1, p3, p5, p7, p9 and p11 will be referred to as second surfaces in the present application. As shown in FIG. 9, the first surfaces and the second surfaces are alternately disposed in the circumferential direction.

All of the first surfaces are tilted at an equal angle with respect to the circumferential direction. All of the second surfaces are tilted at an equal angle with respect to the circumferential direction. The tilt angles to the circumferential direction are different between the first and second surfaces. As compared with the second surface, the first surface has a greater tilt angle to the circumferential direction.

The planes p1 to p12 are divided through an edge line r or a valley line t. For example, the second surface p1 and the first surface p2 are divided through the valley line t. For example, the first surface p2 and the second surface p3 are divided through the edge line r. The edge line r forms a set of apexes of projections. The valley line t forms a set of the deepest points of recesses (dents).

The first surface and the second surface are divided by the edge line r or the valley line t and are continuously disposed each other in the circumferential direction. The lower surface 42 is constituted by only the first surfaces and the second surfaces. In the lower surface 42, all the planes between a certain first surface and another first surface are occupied by the second surfaces. In the lower surface 42, all the planes between a certain second surface and another second surface are occupied by the first surfaces. By this structure, areas of the first surfaces and the second surfaces are maximized. By maximizing the area of the first surfaces, it is possible to enhance a relative rotation controlling effect. By maximizing the area of the second surfaces, it is possible to easily carry out a work for causing the lower surface 42 to abut on a receiving surface 60 (which will be described below). The inner member 8 can easily be attached to and removed from the head 4.

As shown in FIG. 9, in the lower surface 42, the valley lines t and the edge lines r are alternately arranged in the circumferential direction. As shown in FIG. 9, the edge lines r are disposed at a regular interval in the circumferential direction. In the lower surface 42 according to the present embodiment, the edge lines r are disposed every 60 degrees in the circumferential direction. The valley lines t are disposed at a regular interval in the circumferential direction. In the lower surface 42 according to the present embodiment, the valley lines t are disposed every 60 degrees in the circumferential direction. In the lower surface 42, an angle At in the circumferential direction which is defined by the adjacent valley lines t to each other in the circumferential direction is equal to an angle Ar in the circumferential direction which is defined by the adjacent edge lines r to each other in the circumferential direction. In the lower surface 42 according to the present embodiment, the angles At and Ar are 60 degrees. The angles At and Ar have values obtained by dividing 360 (degrees) by N. N is an integer which is equal to or greater than two. In the lower surface 42 according to the present embodiment, N is six. The integer N will be explained in detail in relation to a rotational symmetry which will be described below.

The lower surface 42 has a rotational symmetry in which a central axis Z2 of the inner member 8 is set to be a rotational symmetric axis. The details of the rotational symmetry will be described below.

As seen on the plane in FIG. 9, the valley lines t and the edge lines r are extended radially from the apex t1. An angle defined by a central axis Z2 of the inner member 8 and the edge line r is constant for all of the edge lines r. Lengths of all the edge lines rare equal to each other. An angle defined by the central axis Z2 of the inner member 8 and the valley line t is constant for all of the valley lines t. Lengths of all the valley lines t are equal to each other. The central axis Z2 of the inner member 8 passes through the apex t1. One of ends of the valley lines t serves as the apex t1 and the other end of the valley lines t is positioned on the external surface of the large diameter portion 54. One of ends of the edge lines r serves as the apex t1 and the other end of the edge lines r is positioned on the external surface of the large diameter portion 54. The central axis Z2 and the shaft axis Z1 are substantially coincident with each other.

As shown in FIG. 9, in the case in which the lower surface 42 is seen from a lower side, the valley line t and the edge line r with the closest relationship in the circumferential direction has a positional relationship in which the valley line t is set onto a clockwise side of the edge line r. In the case in which the lower surface 42 is perspectively seen from an upper side (a grip side), accordingly, the valley line t and the edge line r with the closest relationship in the circumferential direction has a positional relationship in which the valley line t is set onto a counterclockwise side of the edge line r. In case of a left-handed golf club, the positional relationship between the valley line t and the edge line r is reversed.

The first surfaces p2, p4, p6, p8, p10 and p12 are tilted with respect to the circumferential direction. In hitting, a head collides with a ball. By the collision, a relative rotation can be generated between the inner member and the hosel hole. The first surfaces p2, p4, p6, p8, p10 and p12 are extended in such a direction as to enable a generation of a force capable of inhibiting the relative rotation in the hitting together with the receiving surface 60. The first surfaces p2, p4, p6, p8, p10 and p12 are tilted in such a direction as to enable a generation of the force capable of inhibiting the relative rotation together with the receiving surface 60. The first surfaces p2, p4, p6, p8, p10 and p12 may be parallel with the central axis Z2.

The second surfaces p1, p3, p5, p7, p9 and p11 are tilted with respect to the circumferential direction. Tilt angles of the second surfaces p1, p3, p5, p7, p9 and p11 with respect to the circumferential direction are gentler than the tilt angles of the first surfaces with respect to the circumferential direction. More specifically, the second surfaces p1, p3, p5, p7, p9 and p11 are extended in a closer direction to the circumferential direction than the first surfaces. The second surfaces p1, p3, p5, p7, p9 and p11 do not generate the force capable of inhibiting the relative rotation in the hitting together with the receiving surface 60.

A tilt direction to the circumferential direction of the second surface is reverse to a tilt direction to the circumferential direction of the first surface. The present embodiment relates to a right-handed golf club. In case of a left-handed golf club, the tilt direction to the circumferential direction of the first surface is reverse to the right-handed golf club. In case of the left-handed golf club, similarly, the tilt direction to the circumferential direction of the second surface is reverse to the right-handed golf club.

As shown in FIGS. 3 and 11, the head 4 has the receiving surface 60. The receiving surface 60 serves as a bottom face of the hosel hole 28. The receiving surface 60 is a recess and projection surface. A shape of the recess and projection surface corresponds to a shape of the lower surface 42 of the inner member 8.

As shown in FIG. 11, the receiving surface 60 is constituted by a plurality of planes. The receiving surface 60 is constituted by 12 planes. The receiving surface 60 is constituted by planes s1, s2, s3, s4, s5, s6, s7, s8, s9, s10, s11 and s12 (see FIG. 11).

The planes s1 to s12 are divided through an edge line r and a valley line t. As shown in FIG. 11, the edge line r and the valley line t are arranged alternately in a circumferential direction.

As seen on a plane in FIG. 11, referring to the receiving surface 60, the valley lines t and the edge lines r are arranged alternately in the circumferential direction. As seen on the plane in FIG. 11, the valley lines t and the edge lines r are extended radially from the lowest point r1. One of ends of the valley lines t serve as the lowest point r1 and the other end of the valley lines t are positioned on a surface of the non-screw portion 27. One of ends of the edge lines r serve as the lowest point r1 and the other end of the edge lines r are positioned on the surface of the non-screw portion 27. An angle defined by a central axis Z3 of the hosel hole 28 and the edge line r is constant for all of the edge lines r. Lengths of all the edge lines r are equal to each other. An angle defined by the central axis Z3 and the valley line t is constant for all of the valley lines t. Lengths of all the valley lines t are equal to each other. The central axis Z3 passes through the lowest point r1. The central axis Z3 and the shaft axis Z1 are substantially coincident with each other.

The receiving surface 60 is a recess and projection surface corresponding to the lower surface 42 of the inner member 8. The lower surface 42 and the receiving surface 60 are provided in face contact with each other. The edge line r of the lower surface 42 and the valley line t of the receiving surface 60 are provided in line contact with each other. The valley line t of the lower surface 42 and the edge line r of the receiving surface 60 are provided in line contact with each other. The planes p1 and s1 are provided in face contact with each other. The planes p2 and s2 are provided in face contact with each other. The planes p3 and s3 are provided in face contact with each other. The planes p4 and s4 are provided in face contact with each other. The planes p5 and s5 are provided in face contact with each other. The planes p6 and s6 are provided in face contact with each other. The planes p7 and s7 are provided in face contact with each other. The planes p8 and s8 are provided in face contact with each other. The planes p9 and s9 are provided in face contact with each other. The planes p10 and s10 are provided in face contact with each other. The planes p11 and s11 are provided in face contact with each other. The planes p12 and s12 are provided in face contact with each other. The whole lower surface 42 and the whole receiving surface 60 are provided in face contact with each other. The planes constituting the lower surface 42 and the planes constituting the receiving surface 60 are provided in face contact with each other.

The plane constituting the receiving surface 60 can be classified into first receiving surfaces and second receiving surfaces. The first receiving surfaces can abut on the first surfaces p2, p4, p6, p8, p10 or p12. The first receiving surfaces include the planes s2, s4, s6, s8, s10 and s12. The second receiving surfaces can abut on the second surfaces p1, p3, p5, p7, p9 or p11. The second receiving surfaces include the planes s1, s3, s5, s7, s9 and s11.

As shown in FIG. 11, the first receiving surfaces and the second receiving surfaces are alternately disposed in the circumferential direction.

The planes s1 to s12 are divided by the edge lines r or the valley lines t. For example, the second receiving surface s1 and the first receiving surface s2 are divided through the edge line r. For example, the first receiving surface s2 and the second receiving surface s3 are divided through the valley line t. The edge line r forms a set of apexes of projections. The valley line t forms a set of the deepest points of recess.

All of the first receiving surfaces are tilted at an equal angle with respect to the circumferential direction. All of the second receiving surfaces are tilted at an equal angle with respect to the circumferential direction. The tilt angles to the circumferential direction are different between the first and second receiving surfaces. As compared with the second receiving surface, the first receiving surface has a greater tilt angle to the circumferential direction.

The first receiving surfaces and the second receiving surfaces are divided by the edge lines r or the valley lines t and are continuously disposed each other in the circumferential direction. The receiving surface 60 is constituted by only the first receiving surfaces and the second receiving surfaces. By this structure, areas of the first receiving surfaces and the second receiving surfaces are maximized. By maximizing the area of the first receiving surfaces, it is possible to enhance the relative rotation controlling effect. By maximizing the area of the second receiving surfaces, it is possible to easily carry out a work for causing the lower surface 42 to abut on the receiving surface 60. Accordingly, the inner member 8 can easily be attached to and removed from the head 4.

As shown in FIG. 11, in the receiving surface 60, the valley lines t and the edge lines r are alternately arranged in the circumferential direction. As shown in FIG. 11, the edge lines r are disposed at a regular interval in the circumferential direction. In the receiving surface 60 according to the present embodiment, the edge lines r are disposed every 60 degrees in the circumferential direction. The valley lines t are disposed at a regular interval in the circumferential direction. In the receiving surface 60 according to the present embodiment, the valley lines t are disposed every 60 degrees in the circumferential direction. In the receiving surface 60, the angle At in the circumferential direction which is defined by the adjacent valley lines t to each other in the circumferential direction is equal to the angle Ar in the circumferential direction which is defined by the adjacent edge lines r to each other in the circumferential direction. In the receiving surface 60 according to the present embodiment, the angles At and Ar are 60 degrees. The angles At and Ar have values obtained by dividing 360 (degrees) by N. N is an integer which is equal to or greater than two. In the receiving surface 60 according to the present embodiment, N is six. The integer N will be explained in detail in relation to a rotational symmetry which will be described below.

The first receiving surfaces s2, s4, s6, s8, s10 and s12 are tilted to the circumferential direction. As described above, in the hitting, a force to carry out a relative rotation acts between the inner member and the hosel hole. The first receiving surfaces s2, s4, s6, s8, s10 and s12 are extended in a direction in which a force capable of inhibiting the relative rotation can be generated together with the lower surface 42. The first receiving surfaces s2, s4, s6, s8, s10 and s12 are tilted in a direction in which the force capable of inhibiting the relative rotation in the hitting can be generated together with the lower surface 42. The first receiving surfaces s2, s4, s6, s8, s10 and s12 may be parallel with the central axis Z3.

The second receiving surfaces s1, s3, s5, s7, s9 and s11 are tilted to the circumferential direction. Tilt angles of the second receiving surfaces s1, s3, s5, s7, s9 and s11 with respect to the central axis Z3 are gentler than tilt angles of the first receiving surfaces with respect to the central axis Z3. More specifically, the second receiving surfaces s1, s3, s5, s7, s9 and s11 are extended in a closer direction to the circumferential direction than the first receiving surfaces. The second receiving surfaces s1, s3, s5, s7, s9 and s11 do not generate the force capable of inhibiting the relative rotation in the hitting together with the lower surface 42. The second receiving surfaces play a part in an easy fitting operation for the lower surface 42 and the receiving surface 60 together with the second surfaces.

A tilt direction to the circumferential direction of the second receiving surface is reverse to a tilt direction to the circumferential direction of the first receiving surface. The present embodiment relates to the right-handed golf club. In case of the left-handed golf club, the tilt direction to the circumferential direction of the first receiving surface is reverse to the right-handed golf club. In case of the left-handed golf club, similarly, the tilt direction to the circumferential direction of the second receiving surface is reverse to the tilt direction in the right-handed golf club.

In FIG. 9, a double arrow θ indicates an angle in the circumferential direction which is defined by the edge lines r having the closest relationship in the circumferential direction. In FIG. 9, a double arrow α indicates an angle in the circumferential direction which is defined by the edge line r and the valley line t having the closest relationship in the circumferential direction. The angle in the circumferential direction is coincident with an angle indicated as seen on a plane in FIG. 9. In the embodiment shown in FIG. 9, the angle θ is 60 degrees and the angle α is 10 degrees.

In order to increase a sectional angle of a projection setting the edge line r as an apex, thereby enhancing a strength of the inner member 8 in the vicinity of the edge line r, a ratio [α/θ] is preferably equal to or higher than 0.1, is more preferably equal to or higher than 0.15 and is more preferably equal to or higher than 0.20. In order to increase the tilt angles to the circumferential direction of the first surface and the first receiving surface, thereby enhancing the relative rotation controlling effect, the ratio [α/θ] is preferably lower than 0.5, is more preferably equal to or lower than 0.4 and is more preferably equal to or lower than 0.3.

In FIG. 8, a double arrow J indicates a distance in a direction of a shaft axis between an outermost point of the edge line r and an outermost point of the valley line t. The outermost point indicates the most outside point in a radial direction. In order to enhance a durability of the inner member in the lower surface and to improve the relative rotation controlling effect, the distance J in the axial direction is preferably equal to or greater than 1 mm, is more preferably equal to or greater than 1.5 mm and is more preferably equal to or greater than 2 mm. In order to easily fit the lower surface in the receiving surface, thereby enhancing a productivity and to reduce a weight of the inner member 8, the distance J in the axial direction is preferably equal to or smaller than 4 mm, is more preferably equal to or smaller than 3.5 mm and is preferably equal to or smaller than 3 mm.

The shapes of the lower surface 42 and the receiving surface 60 can also be understood as a recess and a projection. In the lower surface 42, at least a part of the recess and projection surface is a surface which is tilted to the circumferential direction. In the lower surface 42 according to the present embodiment, all of the surfaces (the planes p1 top 12) constituting the recesses and the projections are tilted to the circumferential direction.

In the receiving surface 60, at least a part of the recess-projection surface is a surface which is tilted to the circumferential direction. In the receiving surface 60 according to the present embodiment, all of the surfaces (the planes s1 to s12) constituting recesses and projections are tilted to the circumferential direction.

In the lower surface 42, the projection is formed by the first and second surfaces. On the other hand, in the receiving surface 60, a recess is formed by the second receiving surface and the first receiving surface. The projection of the lower surface 42 is fitted in the recess of the receiving surface 60.

In the lower surface 42, the recess is formed by the first surface and the second surface. On the other hand, in the receiving surface 60, the projection is formed by the first receiving surface and the second receiving surface. The projection of the receiving surface 60 is fitted in the recess of the lower surface 42.

In the lower surface 42, the recesses and projections are arranged alternately in the circumferential direction. In the receiving surface 60, the projections and recesses are arranged alternately in the circumferential direction. The recess of the lower surface 42 and the projection of the receiving surface 60 are fitted each other, and the projection of the lower surface 42 and the recess of the receiving surface 60 are fitted each other.

Thus, the lower surface 42 has at least one projection. More specifically, the lower surface 42 has six projections. Moreover, the lower surface 42 has at least one recess. More specifically, the lower surface 42 has six recesses (dents). A section of the projection owned by the lower surface 42 takes a tapered shape. The sectional shape of the projection is a triangle setting the edge line r to be an apex.

Moreover, the receiving surface 60 has at least one projection. More specifically, the receiving surface 60 has six projections. Furthermore, the receiving surface 60 has at least one recess. More specifically, the receiving surface 60 has six recesses (dents). A section of the projection owned by the receiving surface 60 takes a tapered shape. More specifically, the sectional shape of the projection is a triangle setting the edge line r to be an apex.

In the present embodiment, the section of the projection of the lower surface 42 takes the tapered shape. Therefore, the projection of the lower surface 42 is easily fitted in the recess of the receiving surface 60. Moreover, the section of the projection of the receiving surface 60 takes the tapered shape. Therefore, the projection of the receiving surface 60 is easily fitted in the recess of the lower surface 42. Accordingly, the inner member 8 can easily be attached to and removed from the head 4. In other words, the shaft 6 can easily be attached to and removed from the head 4.

As described above, the recess of the lower surface 42 and the projection of the receiving surface 60 are engaged with each other. Moreover, the projection of the lower surface 42 and the recess of the receiving surface 60 are engaged with each other. By a force received by the head from a ball in hitting, a moment (a relative rotating force) capable of relatively rotating the shaft 6 and the head 4 is generated. The shaft 6 and the inner member 8 are bonded to each other. Therefore, the relative rotating force finally acts as a relative rotating force of the inner member 8 and the hosel hole 28. By the relative rotating force, the first surface of the lower surface 42 applies a pressing force F1 to the first receiving surface of the receiving surface 60. The first receiving surface of the receiving surface 60 receives the pressing force F1. As a reaction of the pressing force F1, the first receiving surface of the receiving surface 60 applies a pressing force F2 to the first surface of the lower surface 42. The pressing forces F1 and F2 have equal sizes in reverse directions to each other. By the engagement of the lower surface 42 and the receiving surface 60, thus, the inner member 8 is controlled to be rotated with respect to the hosel hole 28. By the engagement of the first surface of the lower surface 42 and the first receiving surface of the receiving surface 60, the inner member 8 is controlled to be rotated with respect to the hosel hole 28. The lower surface 42 and the receiving surface 60 are engaged to control a rotation of the inner member 8 (a rotation around the shaft axis Z1) in the hosel hole 28. Another member may be provided between the lower surface 42 and the receiving surface 60.

As described above, the downward surface 56 of the screw member 10 and the upward surface 44 of the inner member 8 are engaged with each other. In the embodiment described above, the engagement is indirectly carried out. More specifically, the engagement is implemented through the washer 12. The downward surface 56 and the upward surface 44 may be directly engaged with each other. By the engagement, the inner member 8 is controlled to be moved upward with respect to the hosel hole 28.

The engagement (abutment) of the lower surface 42 and the receiving surface 60 is maintained until the inner member 8 is moved upward with respect to the hosel hole 28. Due to the engagement of the lower surface 42 and the receiving surface 60, the inner member 8 cannot be rotated with respect to the hosel hole 28. By the receiving surface 60, the inner member 8 is also controlled to be moved downward with respect to the hosel hole 28.

Thus, the inner member 8 cannot be moved vertically with respect to the hosel hole 28 and cannot be moved with respect to the hosel hole 28. The inner member 8 is fixed to the hosel hole 28. The inner member 8 and the hosel hole 28 are not bonded to each other. However, the inner member 8 is held in the hosel hole 28 and is fixed to the hosel hole 28.

The shaft 6 having the inner member 8 can be attached to and removed from the head 4. The shaft 6 can be attached by fixing the screw member 10 to the head 4. The shaft 6 can be removed by releasing the fixation of the screw member 10 to the head 4. By loosening a screw mechanism, the fixation of the head 4 and the shaft 6 can easily be released.

Examples of a procedure for assembling the golf club 2 include the following procedure.

[Assembling Procedure] Steps (1) to (5) Which Will be Described Below (1) The screw portion 32 of the screw member 10 is inserted into the washer 14 and the shaft 6 is inserted into the through hole 30 of the screw member 10.

(2) The small diameter portion 52 of the inner member 8 is inserted into the washer 12.

(3) The shaft 6 is inserted into the shaft inserting hole 40 of the inner member 8 and the shaft 6 and the inner member 8 are bonded to each other with an adhesive or the like.

(4) The inner member 8 is inserted into the hosel hole 28.

(5) The screw member 10 and the hosel portion 22 are fixed to each other.

After the assembly is carried out in accordance with the procedure, the shaft 6 can easily be attached and removed. More specifically, the shaft 6 can be attached to and removed from the head 4 through the screw mechanism. When the shaft 6 is to be sold as a component which has not been assembled, a member subjected to the steps (1) to (3) in the assembling procedure may be sold.

The washers 14 and 12 do not need to be provided. However, the washers 12 and 14 are important for reliably engaging the receiving surface 60 with the lower surface 42. In order to achieve an abutment (1) of the receiving surface 60 and the lower surface 42, an abutment (2) of the end face 29 and the downward surface 34 and an abutment (3) of the downward surface 56 of the screw member 10 and the upward surface 44 at the same time, high dimensional precision is required. By setting the washer 14 or 12 to be formed by an elastically deformable material, it is possible to reduce the dimensional precision. From this viewpoint, it is preferable that a material of a member K1 (the washer 14) interposed between the downward surface 34 and the end face 29 should be elastically deformable by an axial force of screw coupling. It is preferable that the abutment (engagement) of the receiving surface 60 and the lower surface 42 should be achieved within a range of the elastic deformation of the member K1 through the axial force of the screw coupling. Similarly, it is preferable that a material of a member K2 (the washer 12) interposed between the downward surface 56 of the screw member 10 and the upward surface 44 should be elastically deformable by the axial force of the screw coupling. It is preferable that the abutment of the receiving surface 60 and the lower surface 42 should be achieved within a range of the elastic deformation of the member K2 through the axial force of the screw coupling. It is preferable that the lower surface 42 should press the receiving surface 60 by the axial force of the screw coupling. By the pressing, it is possible to enhance a relative rotation controlling effect. By the presence of the member K1 or K2, it is possible to easily achieve the structure in which the lower surface 42 presses the receiving surface 60.

In order to enhance a beauty without the interposed member recognized visually, it is preferable that the member K1 (the washer 14) should not be provided but the member K2 (the washer 12) should be provided. In this case, it is preferable that the abutment of the downward surface 34 and the end face 29 should be achieved and the abutment (engagement) of the receiving surface 60 and the lower surface 42 should be achieved within the range of the elastic deformation of the member K2 through the axial force of the screw coupling.

It is also possible to employ a structure in which a clearance is provided between the end face 29 of the hosel portion 22 and the downward surface 34 in a state in which the receiving surface 60 abuts on the lower surface 42. In this case, the structure is preferable in that the abutment of the receiving surface 60 and the lower surface 42 can be reliably carried out and is not preferable in that the clearance between the downward surface 34 and the end face 29 might be recognized visually. In respect of an appearance, it is also preferable that the member K1 should be present. In respect of the appearance, it is preferable that the clearance (space) should not be present between the downward surface 34 and the end face 29.

Figure 12:
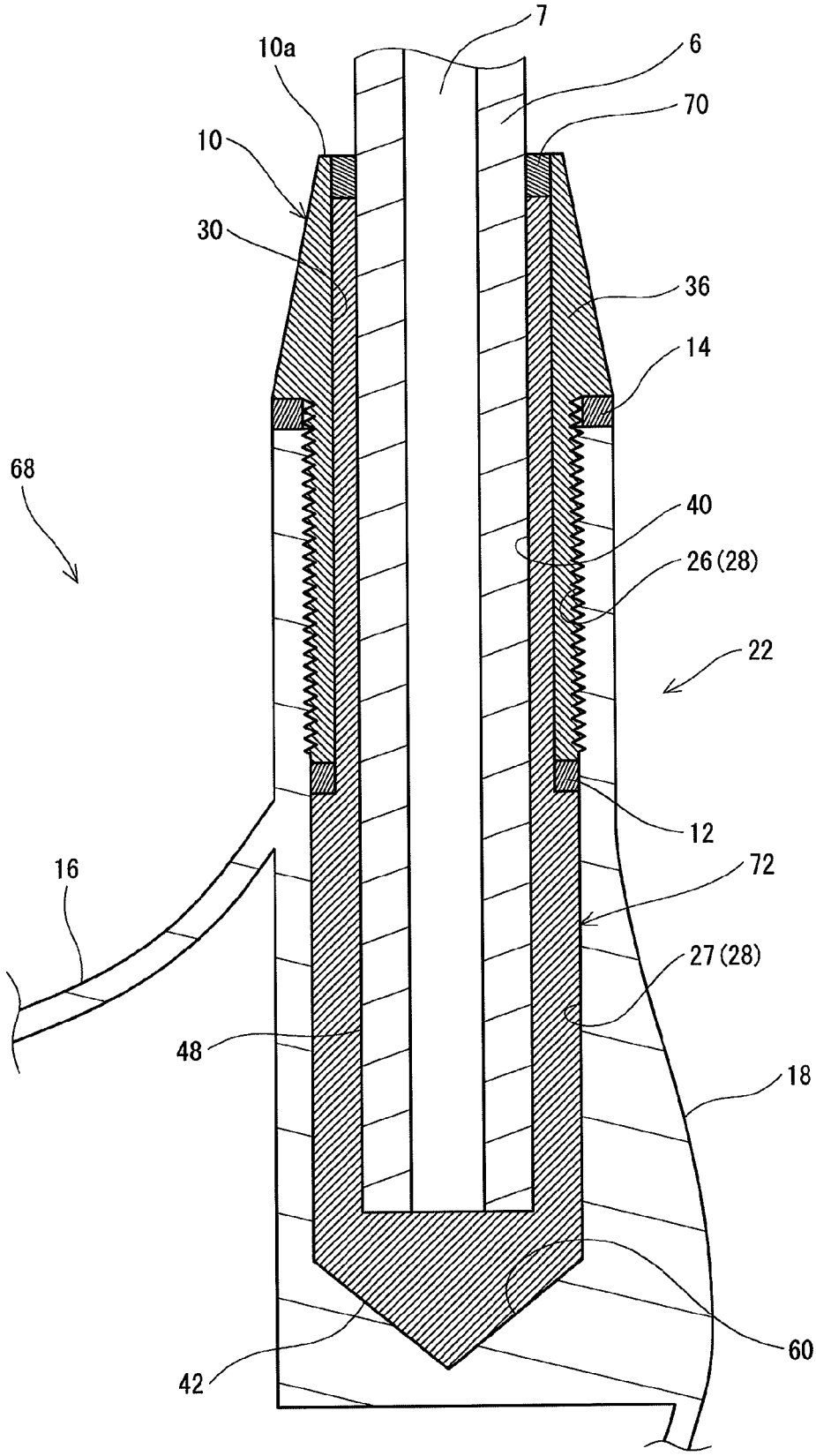
FIG. 12 is a sectional view showing a golf club according to a second embodiment, which is taken along a shaft axis.

FIG. 12 is a sectional view showing the vicinity of a hosel in a head 68 according to a second embodiment. A structure of the head 68 is the same as the structure of the head 4 except that a buffering member 70 is provided. The buffering member 70 is provided on an upper side of an inner member 72. In order to maintain a space for providing the buffering member 70, a length of the inner member 72 is set to be shorter than the length of the inner member 8. An inside diameter of the buffering member 70 is substantially equal to an outside diameter of the shaft 6 in the buffering member 70. An outside diameter of the buffering member 70 is substantially equal to an inside diameter of a screw member 10 (a diameter of a through hole 30). The buffering member 70 is disposed on an upper end of the screw member 10.

In hitting, an impact force acts on the head 68. By the impact force, a stress might act between the head 68 and the shaft 6. The stress tends to concentrate in an upper end face 10*a* of the screw member 10. The buffering member 70 can effectively relieve the concentration of the stress. In order to relieve the concentration of the stress, examples of a material of the buffering member 70 include a resin, a rubber and the like. Examples of the resin include a thermoplastic resin, a thermosetting resin and the like. Examples of the thermoplastic resin include a thermoplastic elastomer. Examples of the thermoplastic elastomer include a thermoplastic urethane elastomer having a hard segment and a soft segment. For the resin, cellulose acetate, cellulose nitrate, an ABS resin and polypropylene are preferable and the cellulose acetate is more preferable.

Figure 13:
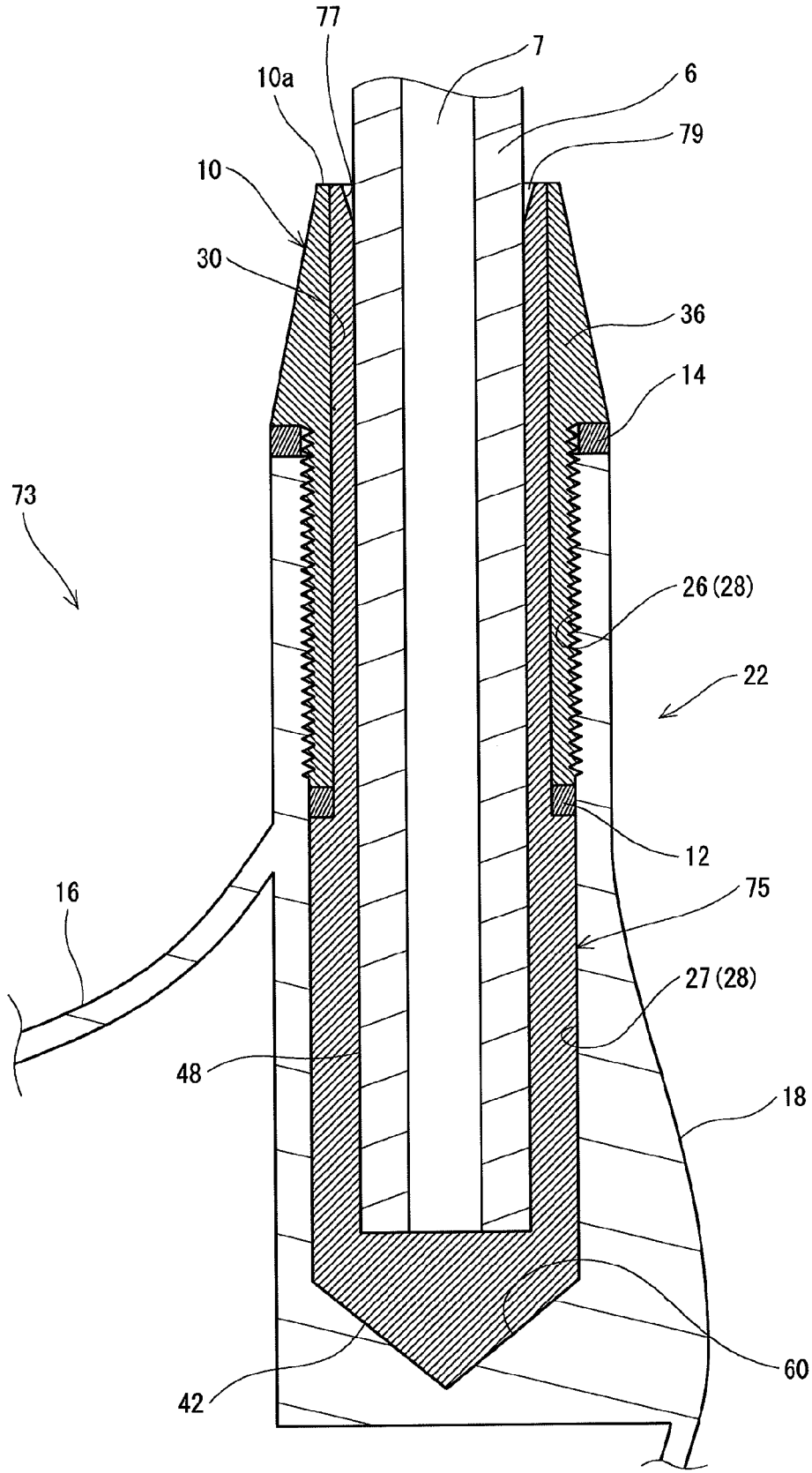
FIG. 13 is a sectional view showing a golf club according to a third embodiment, which is taken along a shaft axis.

FIG. 13 is a sectional view showing the vicinity of a hosel in a head 73 according to a third embodiment. A structure of the head 73 is the same as the structure of the head 4 except for a shape of an upper end of an inner member 75. A tilted surface 77 is provided on an upper end of an internal surface of the inner member 75. The tilted surface 77 is tapered. The tilted surface 77 is a conical recess surface. The tilted surface 77 is tilted apart from a shaft 6 in an upward direction. The tilted surface 77 is tilted to increase an inside diameter of the inner member 75 in the upward direction. By the tilted surface 77, a space 79 is maintained between the inner member 75 and the shaft 6. By the tilted surface 77, it is possible to relieve a concentration of a stress on the shaft 6 which tends to be generated on the upper end face 10*a* of a screw member 10. In the third embodiment, it is possible to relieve the concentration of the stress without providing a buffering member.

Figure 14:
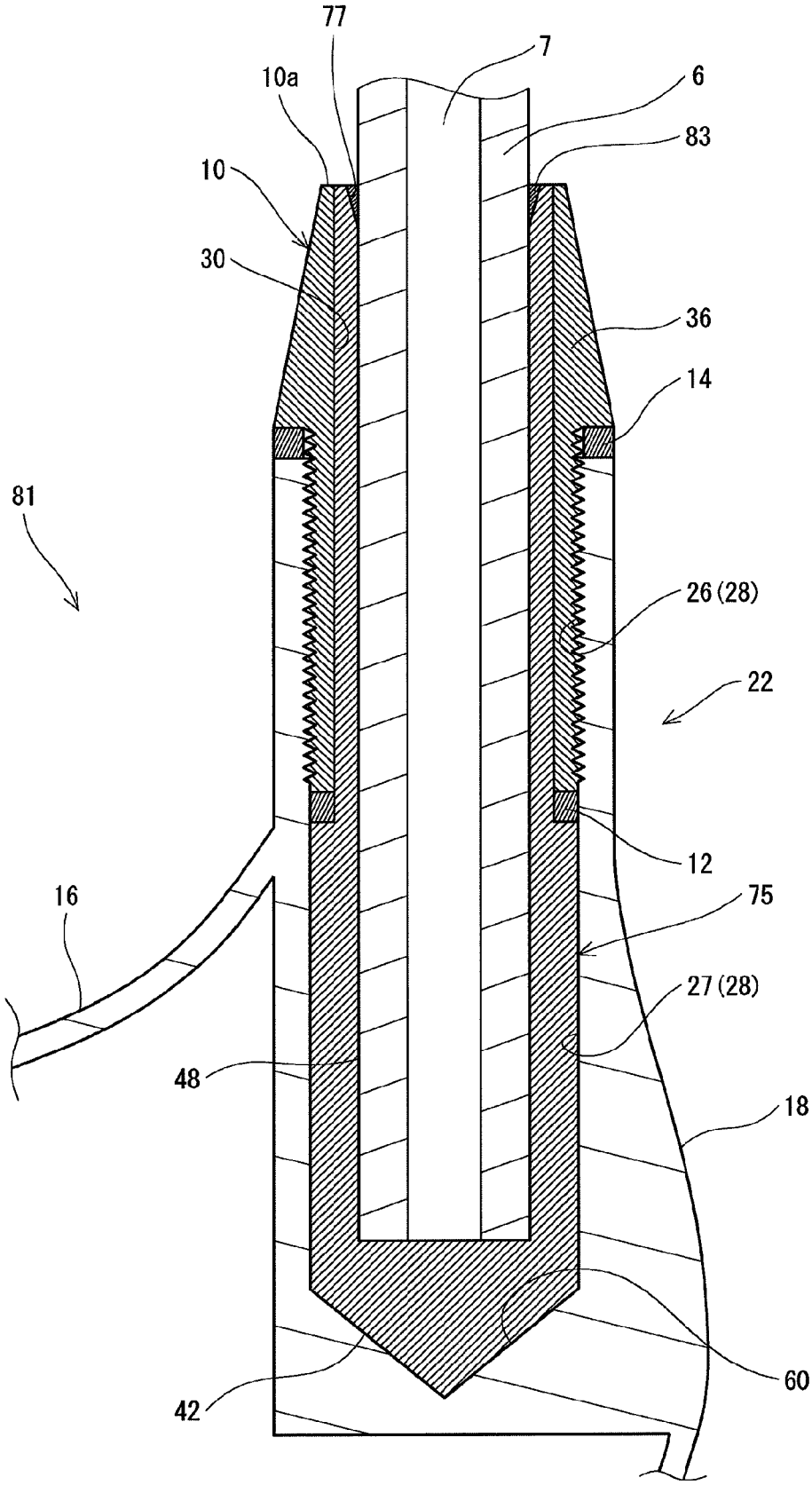
FIG. 14 is a sectional view showing a golf club according to a fourth embodiment, which is taken along a shaft axis.

FIG. 14 is a sectional view showing the vicinity of a hosel in a head 81 according to a fourth embodiment. A structure of the head 81 is the same as the structure of the head 73 except for presence of a buffering member 83. In the head 81, the space 79 is occupied by the buffering member 83. An external surface of the buffering member 83 is tilted. The external surface of the buffering member 83 is a conical projection surface. The external surface of the buffering member 83 abuts on a tilted surface 77. An inside diameter of the buffering member 83 is constant. An outside diameter of the buffering member 83 is increased in the upward direction. An upper end face of the buffering member 83 is substantially on the level with an upper end face 10*a* of a screw member 10. By the buffering member 83, it is possible to still more relieve a concentration of a stress on a shaft 6 which tends to be generated on the upper end face 10*a* of the screw member 10.

Figure 15:
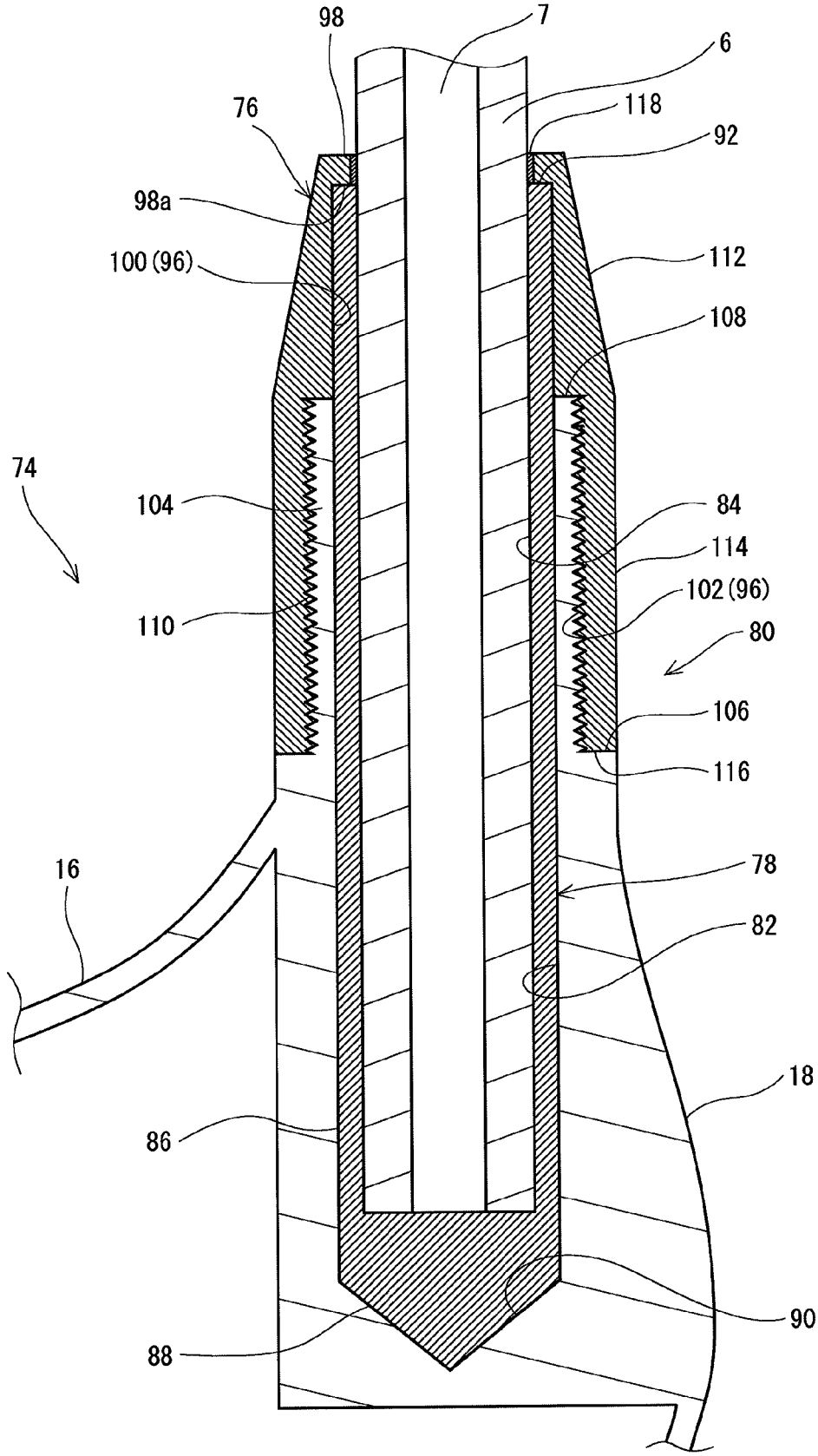
FIG. 15 is a sectional view showing a golf club according to a fifth embodiment, which is taken along a shaft axis.

In the embodiments, the screw portion of the hosel portion is a female screw and the screw portion of the screw member 10 is a male screw. To the contrary, the screw portion of the hosel portion may be the male screw and the screw portion of the screw member may be the female screw. In this case, there is employed a structure in which the male screw is formed on the external surface of the hosel portion and the female screw is formed on the internal surface of the screw member, and the female screw of the screw member is fixed into the outside of the male screw of the hosel portion. FIG. 15 shows an embodiment illustrating an example of the structure.

FIG. 15 is a sectional view showing a head 74 according to a fifth embodiment of the present invention. In the head 74, a screw portion of a hosel portion is a male screw and a screw portion of a screw member is a female screw. The head 74 according to the fifth embodiment has a screw member 76, an inner member 78 and a hosel portion 80. The hosel portion 80 has a hosel hole 82. The inner member 78 has a shaft inserting hole 84. A shaft 6 is inserted and bonded into the shaft inserting hole 84.

The inner member 78 has a cylindrical portion 86 and a lower surface 88. A configuration of the lower surface 88 is the same as the configuration of the lower surface 42 of the inner member 8. A configuration of a receiving surface 90 abutting on the lower surface 88 is the same as the receiving surface 60.

The inner member 8 has the upward surface 44 in the middle position in the longitudinal direction thereof. On the other hand, the inner member 78 according to the present embodiment has no upward surface in a middle position in a longitudinal direction thereof. An outside diameter of the inner member 78 is constant excluding the receiving surface 90. More specifically, an outside diameter of the cylindrical portion 86 is constant. The inner member 78 has no step surface.

An upward surface 92 of the inner member 78 serves as an upper end face of the inner member 78. The upward surface 92 is engaged with the screw member 76.

The screw member 76 has a through hole 96 and an inward extended portion 98. The screw member 76 has a screw portion 102. The screw portion 102 is a female screw. The through hole 96 is constituted by a non-screw portion 100 and the screw portion 102. An inside diameter of the screw portion 102 is larger than an inside diameter of the non-screw portion 100.

The hosel portion 80 has a cylindrical portion 104, an upward surface 106 and an upper end face 108. A through hole penetrating the cylindrical portion 104 constitutes a part of the hosel hole 82. The upward surface 106 is positioned on a lower end of the cylindrical portion 104. The upper end face 108 constitutes an upper end of the cylindrical portion 104.

An external surface of the cylindrical portion 104 is set to be a screw portion 110. The screw portion 110 is a male screw. The screw portion 110 to be the male screw and the screw portion 102 to be a female screw are coupled to each other.

A lower surface 98*a* of the inward extended portion 98 is directly engaged with the upward surface 92 to be the upper end face of the inner member 78. The lower surface 98*a* is a downward surface of the screw member 76. The engagement may be indirectly carried out through a washer or the like. In the screw member 76, the inward extended portion 98 is protruded inward in a radial direction from the non-screw portion 100 of the through hole 96. The inward extended portion 98 takes an annular shape. The inward extended portion 98 may be a projection portion, for example. By the engagement of the inward extended portion 98 and the upward surface 92, the inner member 78 is controlled to be moved upward with respect to the hosel hole 82.

An external surface of the screw member 76 has a tapered surface 112 and a circumferential surface 114. The tapered surface 112 is positioned on an upper side of the circumferential surface 114. The tapered surface 112 and the circumferential surface 114 are continuously provided without a step. A lower end face 116 of the screw member 76 directly abuts on the upward surface 106. The abutment may be indirectly carried out through a washer or the like. An outside diameter of the lower end face 116 is substantially equal to an outside diameter of the upward surface 106. The external surfaces of the screw member 76 and the hosel portion 80 are continuously provided substantially without a step at the lower end of the screw member 76. Consequently, the beauty of the head is enhanced. An outside diameter of the tapered surface 112 is reduced in the upward direction. The tapered surface 112 takes the same shape as a so-called ferrule. The beauty of the head is enhanced by the tapered surface 112.

A buffering member 118 is provided between the inward extended surface 98 and the shaft 6. The buffering member 118 takes an annular shape. The buffering member 118 relieves a concentration of a stress on an upper surface of the inward extended surface 98 so that a durability of the shaft 6 can be enhanced. A preferable material of the buffering member 118 is the same as a material of the buffering member 70.

The configurations of the lower surface of the inner member and the receiving surface are not restricted to the embodiments. In the lower surface of the inner member, a recess and projection formed by two adjacent planes takes a sectional shape of a triangle. The sectional shape may be trapezoidal. Moreover, surfaces constituting the lower surface of the inner member and the receiving surface are not restricted to planes but may be curved surfaces.

It is preferable that the lower surface of the inner member should have at least one projection or recess, each of the projection and the recess in the lower surface should be formed by the first surface and the second surface, the receiving surface should have at least one recess or projection which can come in face contact with the recess or projection of the lower surface, each of the projection and the recess in the receiving surface should be formed by the first receiving surface and the second receiving surface, and the projection present on the lower surface of the inner member or the receiving surface should take a tapered sectional shape. By the tapered shape, the lower surface can easily be caused to abut on the receiving surface. Accordingly, the shaft 6 can readily be attached to and removed from the head 4. This respect has been described above.

In the lower surface of the inner member or the receiving surface, the edge line r may be replaced with a surface. The surface can be formed by chamfering the edge line r according to the embodiments, for example. In this case, the projection formed on the lower surface of the inner member or the receiving surface takes a sectional shape of a trapezoid. The trapezoid takes a tapered shape. In the lower surface of the inner member or the receiving surface, moreover, the valley line t may be replaced with a surface. As described above, it is preferable that the edge line r and the valley line t should not be replaced with the surfaces. In other words, it is preferable that the first and second surfaces should be divided by the edge line r or the valley line t and should be continuously disposed each other. Similarly, it is preferable that the first and second receiving surfaces should be divided by the edge line r or the valley line t and should be continuously disposed each other.

A plane pv which is perpendicular to the shaft axis Z1 may be present on the lower surface of the inner member and the receiving surface. In order to enhance the effect of controlling a relative rotation of the inner member and the hosel hole, it is preferable that the plane pv should not be present on the lower surface of the inner member and the receiving surface. The effect of controlling a relative rotation of the inner member and the hosel hole will also be referred to as a "relative rotation controlling effect" in the present application.

It is preferable that the lower surface of the inner member should have a rotational symmetry in which the central axis Z2 of the inner member 8 is set to be a rotational symmetric axis. The rotational symmetry implies that a coincidence with a shape before a rotation is obtained when a rotation of (360/N) degrees is carried out around the rotational symmetric axis. N is an integer which is equal to or greater than two. It is preferable that the receiving surface should also have the rotational symmetry in which the central axis Z2 (the central axis Z3) is set to be the rotational symmetric axis. A coincidence with a shape before a rotation of (360/N) degrees around the rotational symmetric axis will also be referred to as an "N-fold rotational symmetry". By the rotational symmetry, it is possible to increase the degree of freedom for fitting of the lower surface of the inner member in the receiving surface, thereby engaging the lower surface of the inner member with the receiving surface easily.

In the inner member 8 according to the embodiment, the lower surface 42 has the rotational symmetry in which the central axis Z2 is set to be the rotational symmetric axis. The lower surface 42 is six-fold rotational symmetric with the central axis Z2 set to be the rotational symmetric axis. The receiving surface 60 is also six-fold rotational symmetric. The lower surface 42 and the receiving surface 60 are three-fold rotational symmetric as well as two-fold rotational symmetric, and the N has a maximum value of six. It is preferable that the N of the lower surface 42 should be equal to the N of the receiving surface 60. It is preferable that the maximum value of the N of the lower surface 42 should be equal to a maximum value of the N of the receiving surface 60.

In order to enhance the relative rotation controlling effect and to increase the degree of freedom for the fitting of the lower surface in the receiving surface, the maximum value of the N in the rotational symmetry is preferably equal to or greater than three, is more preferably equal to or greater than four and is further preferably equal to or greater than six. In the case in which the maximum value of the N is great, the projection takes a sharp shape or a width of the projection is reduced. Therefore, a durability of the projection tends to be deteriorated. From this viewpoint, the maximum value of the N is preferably equal to or smaller than 20, is more preferably equal to or smaller than 12 and is further preferably equal to or smaller than eight.

For the configuration to engage the inner member with the hosel portion, it is possible to propose a configuration in which the inner member is provided with a projection which is protruded outward in a radial direction and the hosel portion is provided with a notch extended downward from the end face thereof. By fitting the projection of the inner member in the notch of the hosel portion, it is possible to control the relative rotation of the inner member and the hosel portion. In this case, the notch of the hosel portion can be visually recognized from an outside. Therefore, a different appearance from a conventional golf club is obtained. In respect of a beauty, accordingly, this configuration is not preferable as compared with the present invention. In the case in which the notch of the hosel portion is not present, moreover, a strength can be prevented from being reduced by the presence of the notch. Therefore, it is possible to reduce the thickness of the hosel portion. By reducing the thickness of the hosel portion, it is possible to achieve an increase in a diameter of a tip of the shaft, an increase in a thickness of the inner member, an enhancement in a beauty of the head, and the like.

A material of the head is not restricted. Examples of the material of the head include titanium, a titanium alloy, CFRP (carbon fiber reinforced plastic), stainless steel, maraging steel, a magnesium alloy, an aluminum alloy, iron and the like. It is also possible to employ a head obtained by combining a plurality of materials. It is also possible to employ a head obtained by bonding a head body fabricated through casting to a face portion fabricated through forging or pressing.

A structure of the head is not restricted. The head may be wholly formed integrally or may be obtained by bonding a plurality of members. A method of manufacturing the head is not restricted. Examples of the method of manufacturing the head include casting such as lost-wax precision casting, forging and the like.

A material of the shaft is not restricted. Examples of the material of the shaft include CFRP (carbon fiber reinforced plastic) and a metal. It is possible to suitably use a so-called carbon shaft or steel shaft. Moreover, a structure of the shaft is not restricted.

A material of the inner member is not restricted. In order to suppress an increase in a weight of the club, it is preferable that the inner member should have a small weight. From this viewpoint, a specific gravity of the inner member is preferably equal to or smaller than 4.6 and is more preferably equal to or smaller than 4.5. In order to prevent a breakage from being caused by an impact of hitting, it is preferable that the inner member should have a high strength. From these viewpoints, a preferable material of the inner member includes aluminum, an aluminum alloy, titanium, a titanium alloy, magnesium, a magnesium alloy, CFRP (carbon fiber reinforced plastic), a resin and the like.

A material of the screw member is not restricted. In order to suppress an increase in the weight of the club, it is preferable that the screw member should have a small weight. From this viewpoint, a specific gravity of the screw member is preferably equal to or smaller than 4.6 and is more preferably equal to or smaller than 4.5. In order to prevent the breakage from being caused by the impact of the hitting, it is preferable that the screw member should have a high strength. From these viewpoints, a preferable material of the screw member includes aluminum, an aluminum alloy, titanium, a titanium alloy, magnesium, a magnesium alloy, CFRP (carbon fiber reinforced plastic), a resin and the like.

A material of the washer (the interposed member) is not restricted. In order to suppress an increase in the weight of the club, it is preferable that the washer should have a small weight. From this viewpoint, a specific gravity of the washer is preferably equal to or smaller than 4.6 and is more preferably equal to or smaller than 4.5. In order to prevent the breakage from being caused by the impact of the hitting, it is preferable that the washer should have a high strength. From these viewpoints, a preferable material of the washer includes aluminum, an aluminum alloy, titanium, a titanium alloy, magnesium, a magnesium alloy, CFRP (carbon fiber reinforced plastic), a rubber, a resin and the like. As described above, moreover, the washer is preferably formed by an elastic member and is more preferably formed by the rubber or the resin. A preferable material of the washer (the interposed member) is the same as the material of the buffering member 70.

A double arrow A in FIG. 8 indicates a diameter of the shaft inserting hole. In order to easily insert the shaft, when the outside diameter of the shaft in the portion to be inserted into the shaft inserting hole is set to be D1 mm, the diameter A is preferably equal to or greater than (D1+0.02) mm, is more preferably equal to or greater than (D1+0.03) mm and is further preferably equal to or greater than (D1+0.04) mm. In order to increase a bonding strength to the shaft, A is preferably equal to or smaller than (D1+0.20) mm, is more preferably equal to or smaller than (D1+0.15) mm, and is further preferably equal to or smaller than (D1+0.10) mm. Usually, the outside diameter D1 of the shaft is equal to or greater than 8.5 mm and is equal to or smaller than 10.0 mm.

A double arrow B in FIG. 8 indicates an outside diameter (mm) of the small diameter portion. In order to enhance a durability of the inner member, a thickness of the small diameter portion [(B−A)/2] is preferably equal to or greater than 0.25 mm, is more preferably equal to or greater than 0.30 mm and is further preferably equal to or greater than 0.40 mm. In order to control a weight of the inner member and to prevent a center of gravity of the head from being excessively close to a heel, the thickness of the small diameter portion [(B−A)/2] is preferably equal to or smaller than 1.50 mm, is more preferably equal to or smaller than 1.20 mm and is further preferably equal to or smaller than 0.8 mm.

A double arrow C in FIG. 8 indicates an outside diameter (mm) of the large diameter portion 54. In order to enhance the durability of the inner member, a width in a radial direction of the upward surface [(C−B)/2] is preferably equal to or greater than 0.25 mm, is more preferably equal to or greater than 0.30 mm and is further preferably equal to or greater than 0.40 mm. In order to control the weight of the inner member and to prevent the center of gravity of the head from being excessively close to the heel, the width in the radial direction of the upward surface [(C−B)/2] is preferably equal to or smaller than 1.50 mm, is more preferably equal to or smaller than 1.20 mm and is further preferably equal to or smaller than 0.8 mm.

A double arrow D in FIG. 8 indicates a length in an axial direction of the small diameter portion. The length D is measured along the central axis Z2 of the inner member. In order to increase a length in an axial direction of the screw portion of the screw member, thereby enhancing a fastening force of the screw coupling, the length D is preferably equal to or greater than 11 mm, is more preferably equal to or greater than 15 mm and is further preferably equal to or greater than 20 mm. If the length D is too great, the size of the screw member is increased excessively so that the weight of the head tends to be increased excessively. From this viewpoint, the length D is preferably equal to or smaller than 35 mm, is more preferably equal to or smaller than 31 mm and is further preferably equal to or smaller than 28 mm.

A double arrow E in FIG. 8 indicates a depth of the shaft inserting hole 40. The depth E is measured along the central axis Z2. In order to increase the bonding strength to the shaft, the depth E is preferably equal to or greater than 25 mm, is more preferably equal to or greater than 30 mm and is further preferably equal to or greater than 35 mm. In order to prevent the weight from being increased excessively, the length E is preferably equal to or smaller than 45 mm, is more preferably equal to or smaller than 43.5 mm and is further preferably equal to or smaller than 42 mm.

A double arrow F in FIG. 8 indicates a length in an axial direction of the lower surface of the inner member. The length F is measured along the central axis Z2. In order to enhance the relative rotation controlling effect, the length F is preferably equal to or greater than 3 mm, is more preferably equal to or greater than 4 mm and is further preferably equal to or greater than 5 mm. In order to control the weight, the length F is preferably equal to or smaller than 10 mm, is more preferably equal to or smaller than 9 mm and is further preferably equal to or smaller than 8 mm.

A double arrow G in FIG. 3 indicates a thickness of the downward surface 56 of the screw member. The thickness G is measured in the radial direction. In order to increase the rigidity of the screw member, the thickness G is preferably equal to or greater than 0.5 mm, is more preferably equal to or greater than 0.6 mm and is further preferably equal to or greater than 0.7 mm. In order to prevent the weight from being increased excessively, the thickness G is preferably equal to or smaller than 2 mm, is more preferably equal to or smaller than 1.5 mm and is further preferably equal to or smaller than 1 mm.

A double arrow H in FIG. 3 indicates a thickness of the tapered surface provided in the exposed portion of the screw member. The thickness H is measured in the radial direction.

In order to increase the strength of the screw member, the thickness H is preferably equal to or greater than 0.5 mm, is more preferably equal to or greater than 0.7 mm and is further preferably equal to or greater than 0.9 mm. In order to prevent the weight from being increased excessively, the thickness H is preferably equal to or smaller than 2 mm, is more preferably equal to or smaller than 1.7 mm and is further preferably equal to or smaller than 1.3 mm.

A double arrow M in FIG. 3 indicates a hole diameter of the non-screw portion 27 in the hosel hole 28. In order to reliably support the inner member through the hosel hole, it is preferable that the outside diameter C of the large diameter portion 54 should be almost equal to the hole diameter M of the non-screw portion 27. More specifically, it is preferable that the outside diameter C (mm) and the hole diameter M (mm) should satisfy the following expression.

$$[M-0.20] \leqq C \leqq M$$

As described above, in the embodiments, the shaft 6 and the head 4 are fixed to each other through the engagement of the downward surface 56 and the upward surface 44 and the engagement of the receiving surface 60 and the lower surface 42. As described above, it is possible to implement the golf club 2 in which the head and the shaft can freely be attached to and removed from each other with a simple structure. The screw portion on the head side can easily be fabricated if the head has an ordinary hosel. More specifically, the present invention can be applied to a head having a general structure and has a high universality.

EXAMPLES

Although the advantages of the present invention will be apparent from examples, the present invention should not be construed restrictively based on description of the examples.

Example 1

In the same manner as in FIGS. 1 to 11, a head, a shaft, an inner member, a screw member and a washer were fabricated. Their structures and shapes were set to be the same as those in the first embodiment. The head was integrally formed through lost-wax precision casting. A material of the head was set to be Ti-6Al-4V. A weight of the head was 170 g. A material of the inner member was set to be an aluminum alloy. A weight of the inner member was 4.2 g. A material of the screw member was set to be an aluminum alloy. A weight of the screw member was 2.5 g. Both of materials of two washers were set to be resins. A type of the resin was set to be an urethane resin. A weight of a first washer corresponding to the washer 12 was set to be 0.2 g. A weight of a second washer corresponding to the washer 14 was set to be 0.4 g. They were assembled in accordance with the above-mentioned procedure so that the same golf club as the golf club 2 was obtained. Trade name "ESPRENE" manufactured by Tohritu Kasei Kohgyou Co., Ltd. was used as an adhesive for bonding the shaft to the inner member.

In the example 1, the diameter A was set to be 9.05 mm, the outside diameter B of the small diameter portion was set to be 10.4 mm, the outside diameter C of the large diameter portion was set to be 11.8 mm, the length D was set to be 25.5 mm, the depth E was set to be 41 mm, the length F was set to be 7.0 mm, the thickness G was set to be 0.6 mm, the thickness H was set to be 1.0 mm, and the hole diameter M was set to be 11.9 mm. The outside diameter D1 of the shaft was set to be 9.0 mm. The specifications and evaluation result according to the Example 1 is shown in the following Table 1.

Examples 2 to 6

A golf club according to each of examples 2 to 6 was obtained in the same manner as in the example 1 except for the specification(s) shown in the Table 1. The specifications and evaluation results are shown in the following Table 1.

Comparative Example 1

FIGS. 16, 17, 18, 19 and 20 are views showing a comparative example 1.

Figure 16:
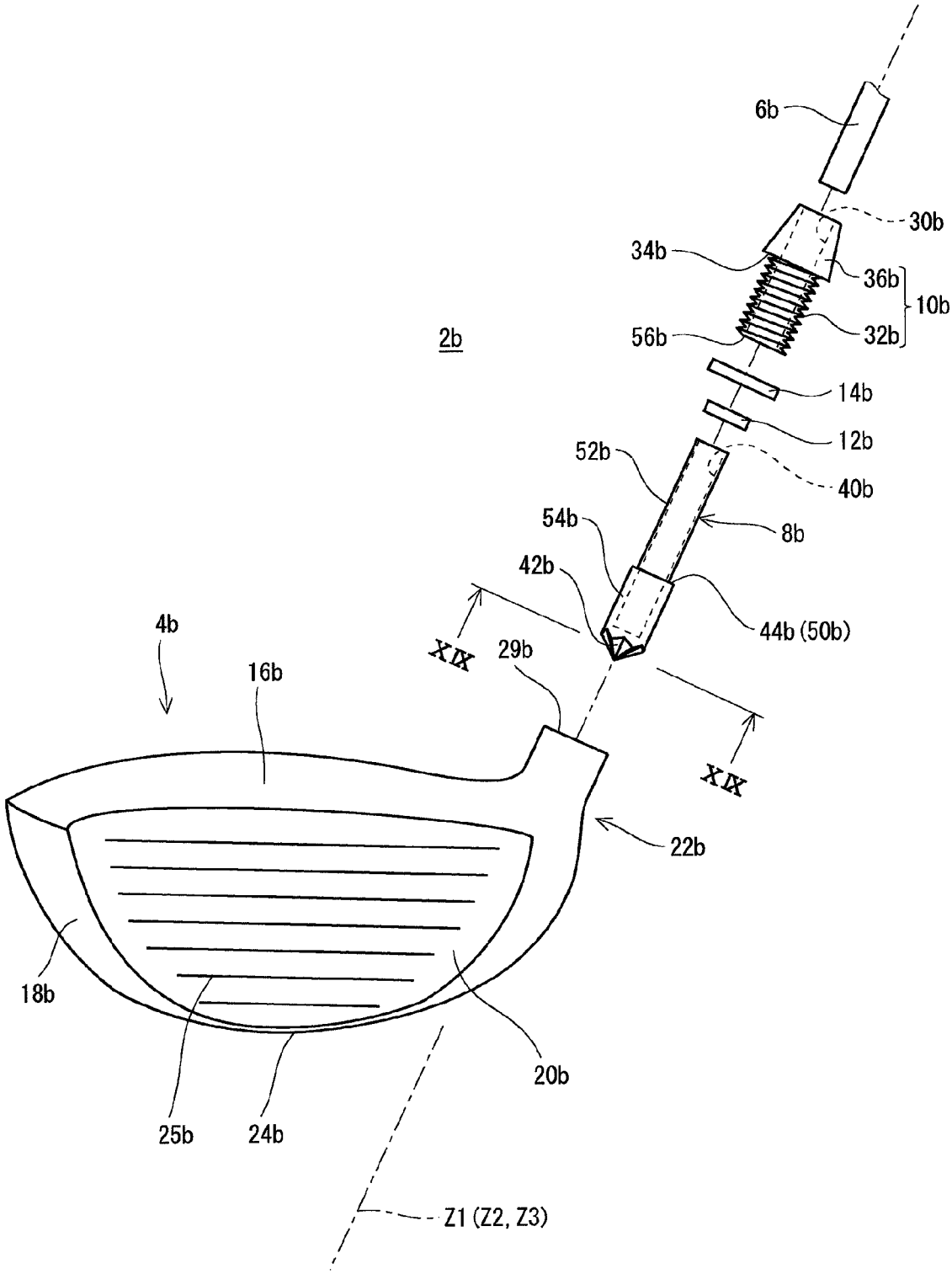
FIG. 16 is an exploded view showing a golf club according to a comparative example 1.

FIG. 16 is an exploded view showing a golf club 2*b* according to the comparative example 1. The golf club 2*b* has a head 4*b* and a shaft 6*b*. The shaft 6*b* is the same as the shaft according to the example 1.

As shown in FIG. 16, the golf club 2*b* includes an inner member 8*b*, a screw member 10*b*, a washer 12*b* and a washer 14*b*. The head 4*b* has a crown portion 16*b*, a side portion 18*b*, a face portion 20*b*, a hosel portion 22*b* and a sole portion 24*b*. The head 4*b* is hollow. The face portion 20*b* is provided with a face line 25*b*.

The screw member 10*b* has a through hole 30*b*, a screw portion 32*b*, and downward surfaces 34*b* and 56*b*. Furthermore, the screw member 10*b* has an exposed portion 36*b*. The through hole 30*b* penetrates the screw portion 32*b* and the exposed portion 36*b*.

Figure 17:
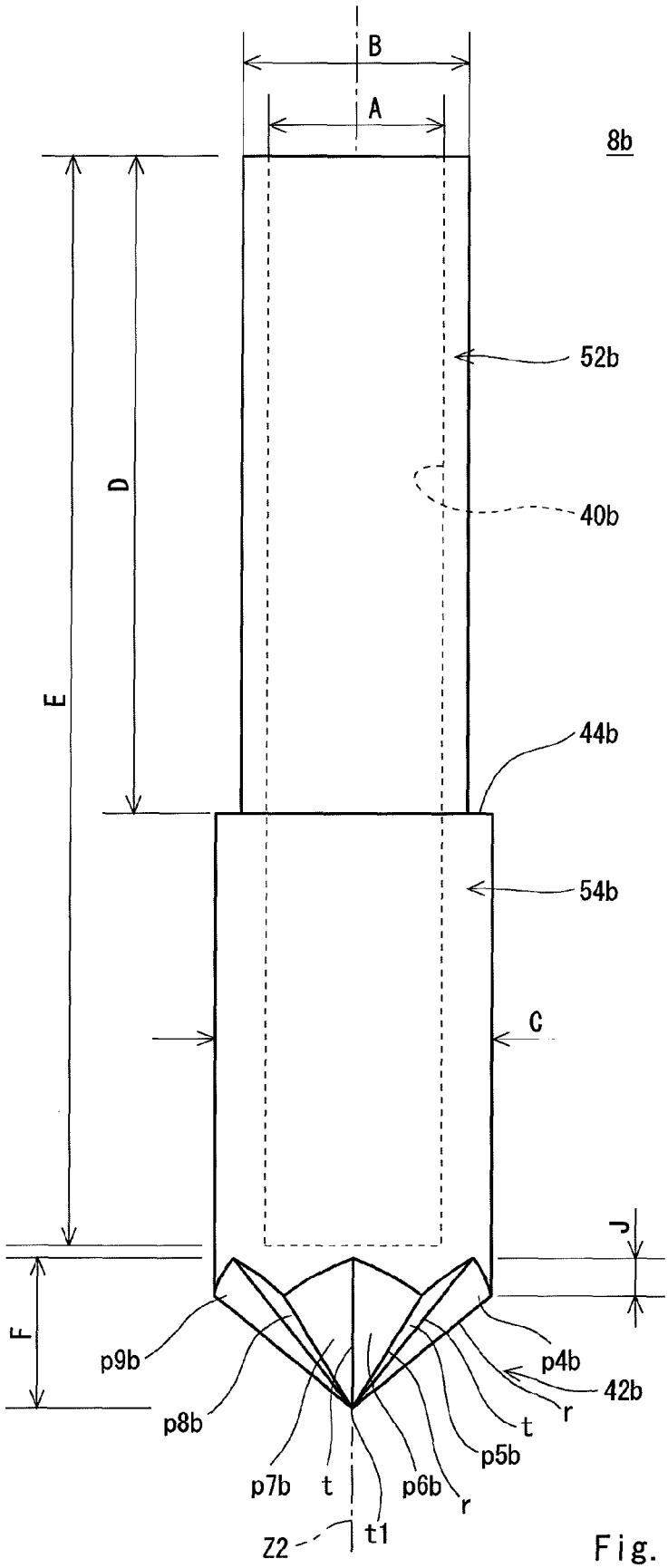
FIG. 17 is a side view showing an inner member according to the comparative example 1.
Figure 18:
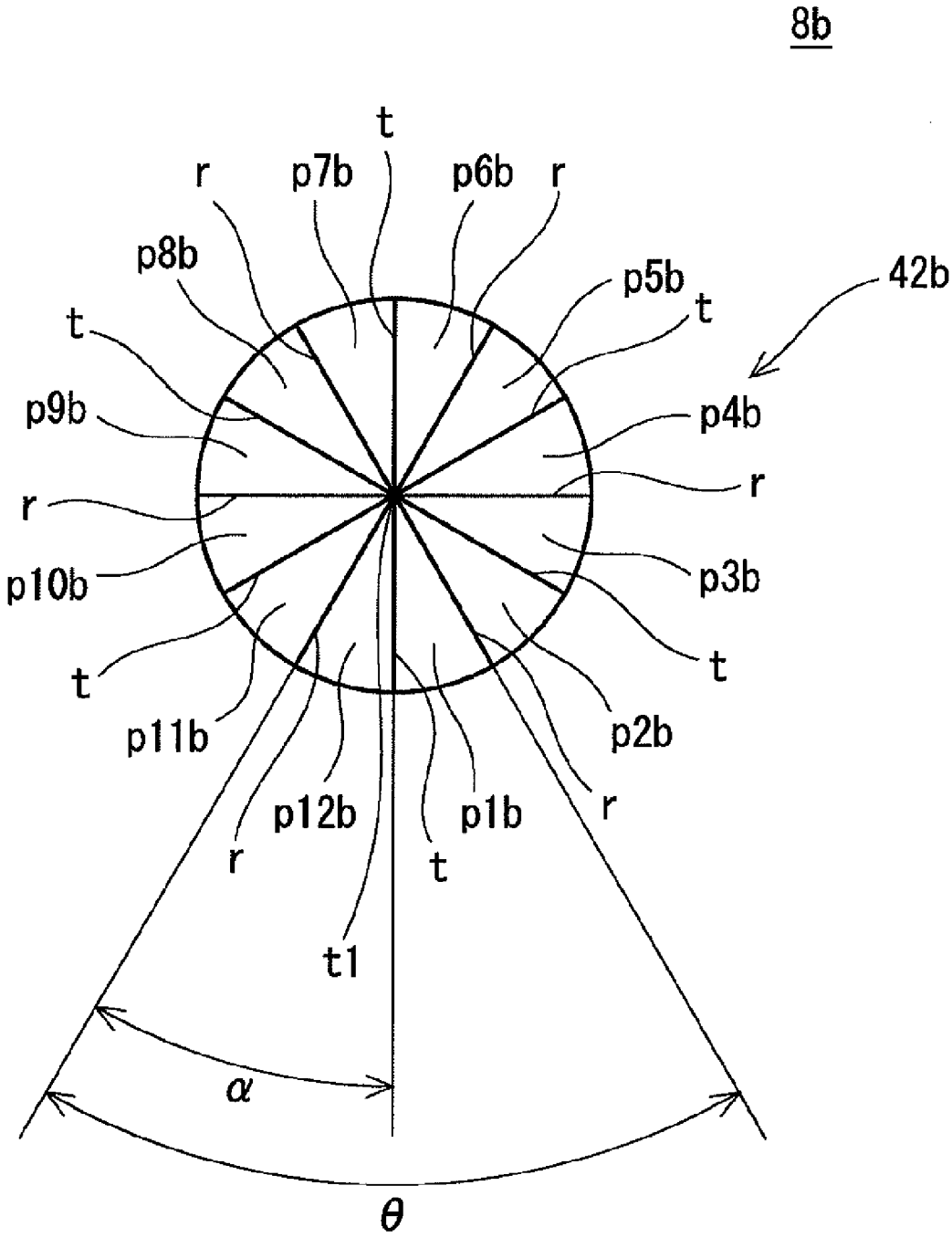
FIG. 18 is a plan view showing a lower surface of the inner member in FIG. 17.
Figure 19:
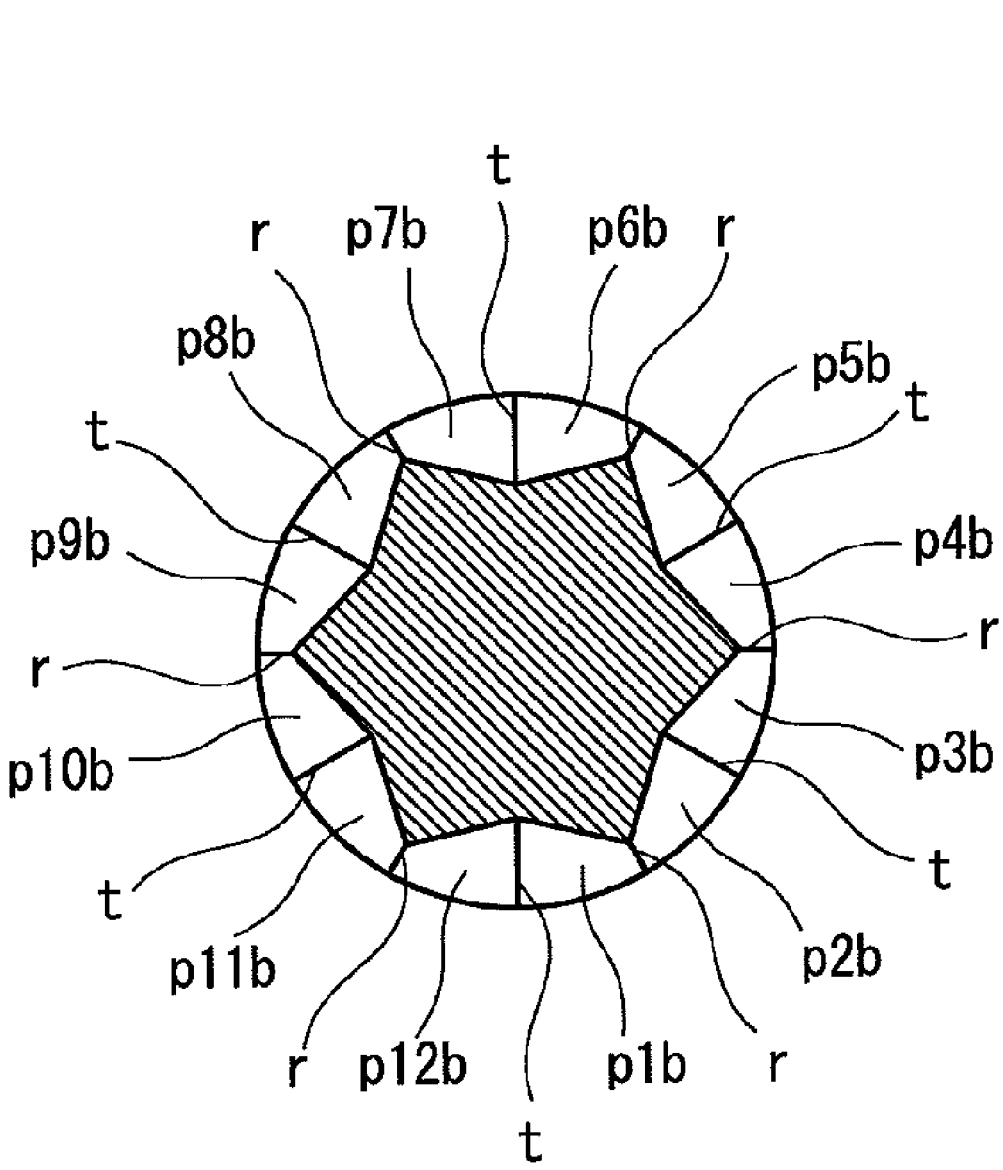
FIG. 19 is a sectional view taken along an XIX-XIX line in FIG. 16.
Figure 20:
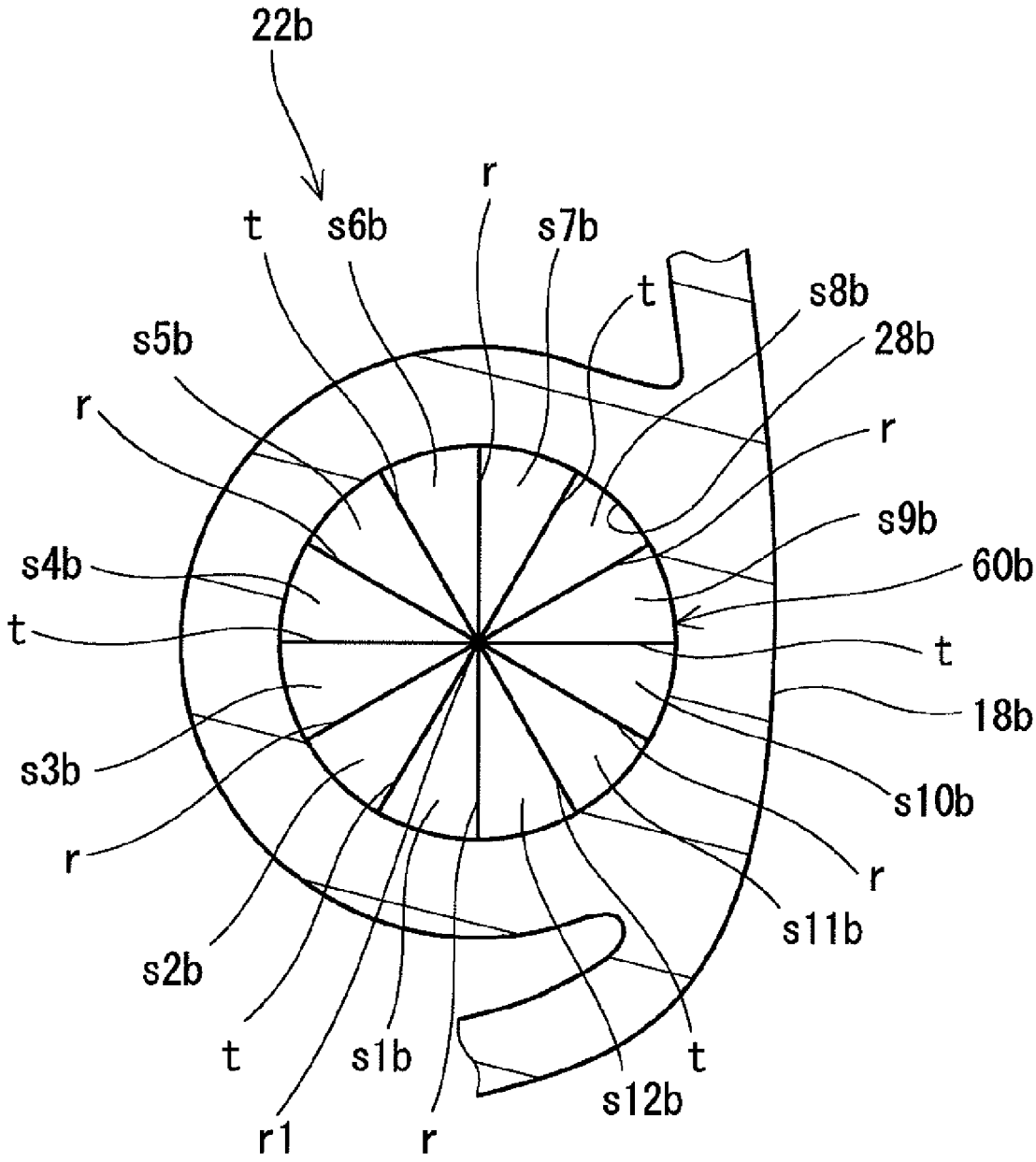
FIG. 20 is a sectional view showing a hosel portion in a head according to the comparative example 1.

FIG. 17 is a side view showing the inner member 8*b*. FIG. 18 is a plan view showing the inner member 8*b* seen from below. FIG. 19 is a sectional view showing the inner member 8*b* taken along an XIX-XIX line in FIG. 16. FIG. 20 is a sectional view showing the hosel portion 22*b*.

The inner member 8*b* has a shaft inserting hole 40*b*, a lower surface 42*b* and an upward surface 44*b*. The shaft inserting hole 40*b* is opened toward an upper end side of the inner member 8*b*. The shaft inserting hole 40*b* is opened at an upper end face 46*b* of the inner member 8*b*. An outside diameter of an upper part (a small diameter portion 52*b*) of the inner member 8*b* is smaller than an outside diameter of a lower part (a large diameter portion 54*b*) of the inner member 8*b*. Due to a difference in the outside diameter, a step surface 50*b* is provided. The washer 12*b* is provided between the lower end face 56*b* of the screw member 10*b* and the upward surface 44*b*.

As shown in FIG. 17, the lower surface 42*b* wholly takes a tapered shape. The lower surface 42*b* of the inner member 8*b* is a recess and projection surface. The lower surface 42*b* is constituted by a plurality of planes. The lower surface 42*b* is constituted by 12 planes. The lower surface 42*b* is constituted by planes p1*b*, p2*b*, p3*b*, p4*b*, p5*b*, p6*b*, p7*b*, p8*b*, p9*b*, p10*b*, p11*b* and p12*b*. The planes p1*b* to p12*b* are divided by an edge line r and a valley line t.

As shown in FIG. 18, referring to the lower surface 42*b*, the valley lines t and the edge lines r are alternately arranged in a circumferential direction. Furthermore, the valley lines t and the edge lines r are disposed uniformly in the circumferential direction. As seen on a plane of FIG. 18, an angle defined by the valley line t and the edge line r which are adjacent to each other is constant. As seen on the plane of FIG. 18, the valley line t and the edge line r are extended radially from an apex t1. An angle defined by a central axis Z2 of the inner member 8*b* and the edge line r is constant for all of the edge lines r. Lengths of all the edge lines r are equal to each other. An angle defined by the central axis Z2 of the inner member 8*b* and the valley line t is constant for all of the valley lines t. Lengths of all the valley lines t are equal to each other. The central axis Z2 of the inner member 8*b* passes through the apex t1. One of ends of the valley line t serves as the apex t1 and the other end of the valley line t is positioned on the external surface of the large diameter portion 54*b*. One of ends of the edge line r serves as the apex t1 and the other end of the edge line r is positioned on the external surface of the large diameter portion 54*b*. The central axis Z2 and the shaft axis Z1 are substantially coincident with each other.

As shown in FIG. 20, the head 4*b* has a receiving surface 60*b*. The receiving surface 60*b* serves as a bottom face of the hosel hole 28*b*. The receiving surface 60*b* is a recess and projection surface. A shape of the recess and projection surface corresponds to a shape of the lower surface 42*b* of the inner member 8*b*.

As shown in FIG. 20, the receiving surface 60*b* is constituted by a plurality of planes. The receiving surface 60*b* is constituted by twelve planes. The receiving surface 60*b* is constituted by planes s1*b*, s2*b*, s3*b*, s4*b*, s5*b*, s6*b*, s7*b*, s8*b*, s9*b*, s10*b*, s11*b* and s12*b*.

The planes s1*b* to s12*b* are divided through an edge line r and a valley line t. As shown in FIG. 20, the edge line r and the valley line t are arranged alternately in the circumferential direction.

As seen on a plane in FIG. 20, referring to the receiving surface 60*b*, the valley line t and the edge line r are arranged alternately in the circumferential direction. As seen on the plane in FIG. 20, an angle defined by the valley line t and the edge line r which are adjacent to each other is constant. As seen on the plane of FIG. 20, all of the angles defined by the valley lines t and the edge lines r which are adjacent to each other are 30 degrees. One of ends of the edge line r and the valley line t serves as the lowest point r1. An angle defined by a central axis Z3 of the hosel hole 28*b* and the edge line r is constant for all of the edge lines r. Lengths of all the edge lines r are equal to each other. An angle defined by the central axis Z3 and the valley line t is constant for all of the valley lines t. Lengths of all the valley lines t are equal to each other. The central axis Z3 passes through the lowest point r1. The central axis Z3 and the shaft axis Z1 are substantially coincident with each other.

The receiving surface 60*b* is a recess and projection surface corresponding to the lower surface 42*b* of the inner member 8*b*. The lower surface 42*b* and the receiving surface 60*b* are provided in face contact with each other. The edge line r of the lower surface 42*b* and the valley line t of the receiving surface 60*b* are provided in line contact with each other. The valley line t of the lower surface 42*b* and the edge line r of the receiving surface 60*b* are provided in line contact with each other. The whole receiving surface 60*b* is provided in face contact with the whole lower surface 42*b*.

In the lower surface 42*b*, the projection is formed by the plane p1*b* and the plane p2*b*. On the other hand, in the receiving surface 60*b*, a recess is formed by the plane s1*b* and the plane s2*b*. The projection of the lower surface 42*b* is fitted in the recess of the receiving surface 60*b*.

In the lower surface 42*b*, the recess is formed by the plane p2*b* and the plane p3*b*. On the other hand, in the receiving surface 60*b*, the projection is formed by the plane s2*b* and the plane s3*b*. The projection of the receiving surface 60*b* is fitted in the recess of the lower surface 42*b*.

In the lower surface 42*b*, the recesses and projections are arranged alternately in the circumferential direction. In the receiving surface 60*b*, the projections and recesses are arranged alternately in the circumferential direction. The recess of the lower surface 42*b* and the projection of the receiving surface 60*b* are fitted each other, and the projection of the lower surface 42*b* and the recess of the receiving surface 60*b* are fitted each other.

In the lower surface 42*b* and the receiving surface 60*b* according to the comparative example 1, a sectional shape of the projection is laterally symmetrical. In other words, in the lower surface 42*b* and the receiving surface 60*b* according to the comparative example 1, the sectional shape of the projection is an isosceles triangle. In the lower surface 42*b* and the receiving surface 60*b* according to the comparative example 1, a sectional shape of the recess is laterally symmetrical. In other words, in the lower surface 42*b* and the receiving surface 60*b* according to the comparative example 1, the sectional shape of the recess is an isosceles triangle. In the comparative example 1, an angle $\alpha$ is 30 degrees and an angle $\theta$ is 60 degrees. In the comparative example 1, the distance J was set to be 2.0 mm. In the inner member 8*b* according to the comparative example 1, moreover, dimensions A, B, C, D, E and F shown in FIG. 17 were set to be equal to them in the inner member according to the example 1.

The comparative example 1 and the example 1 are different from each other in respect of only the shapes of the lower surface and the receiving surface. The golf club according to the comparative example 1 was obtained in the same manner as in the example 1 except for the shapes of the lower surface and the receiving surface. The specification and evaluation results in the comparative example 1 are shown in the following Table 1.

Comparative Example 2

A golf club according to a comparative example 2 was obtained in the same manner as in the comparative example 1 except that a distance J was changed to be 0.5 mm. A specification and evaluation results in the comparative example 2 are shown in the following Table 1.

Comparative Example 3

FIGS. 21 to 29 are views showing a comparative example 3. The comparative example 3 will be described below with reference to these drawings.

Figure 21:
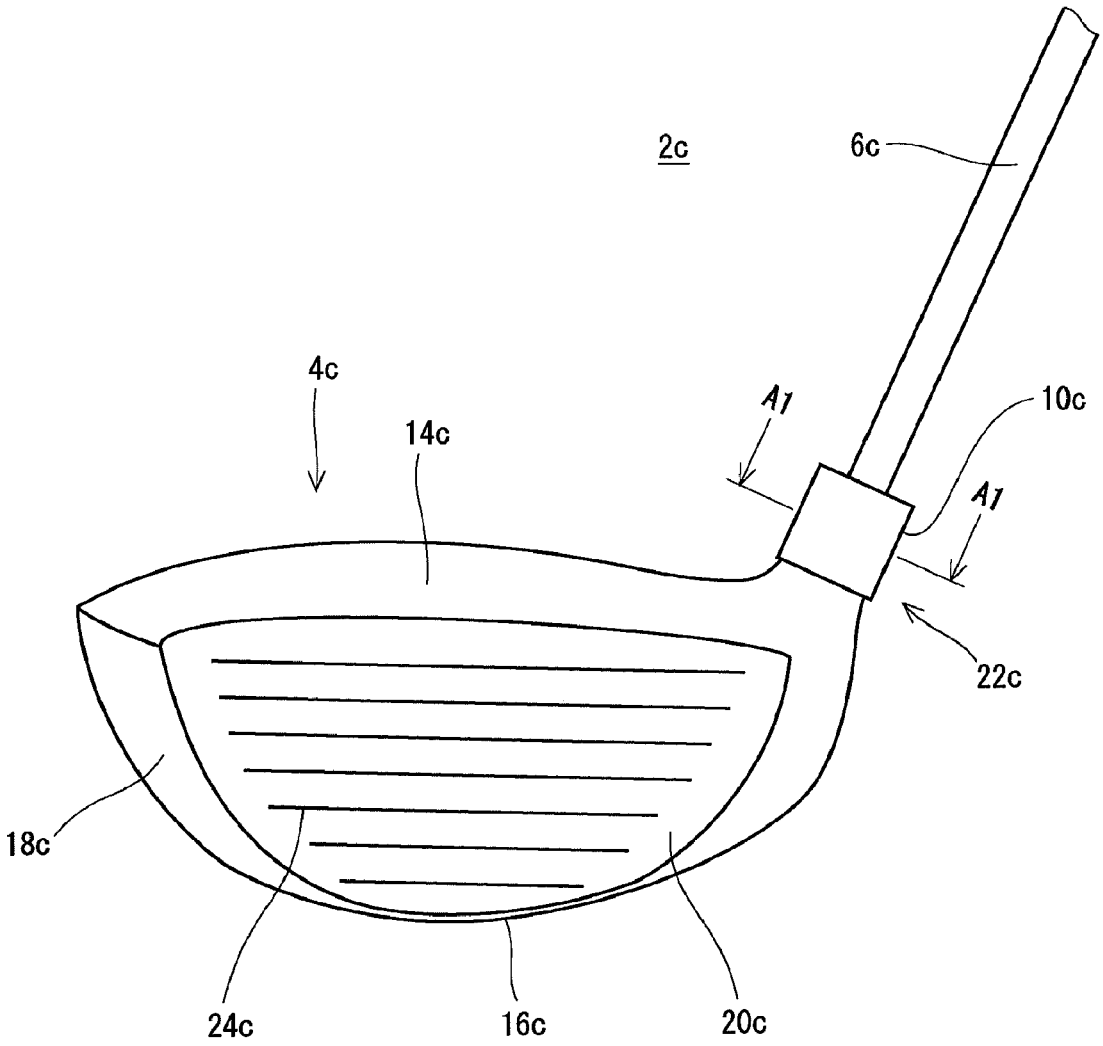
FIG. 21 is a view showing a part of a golf club according to a comparative example 3.
Figure 22:
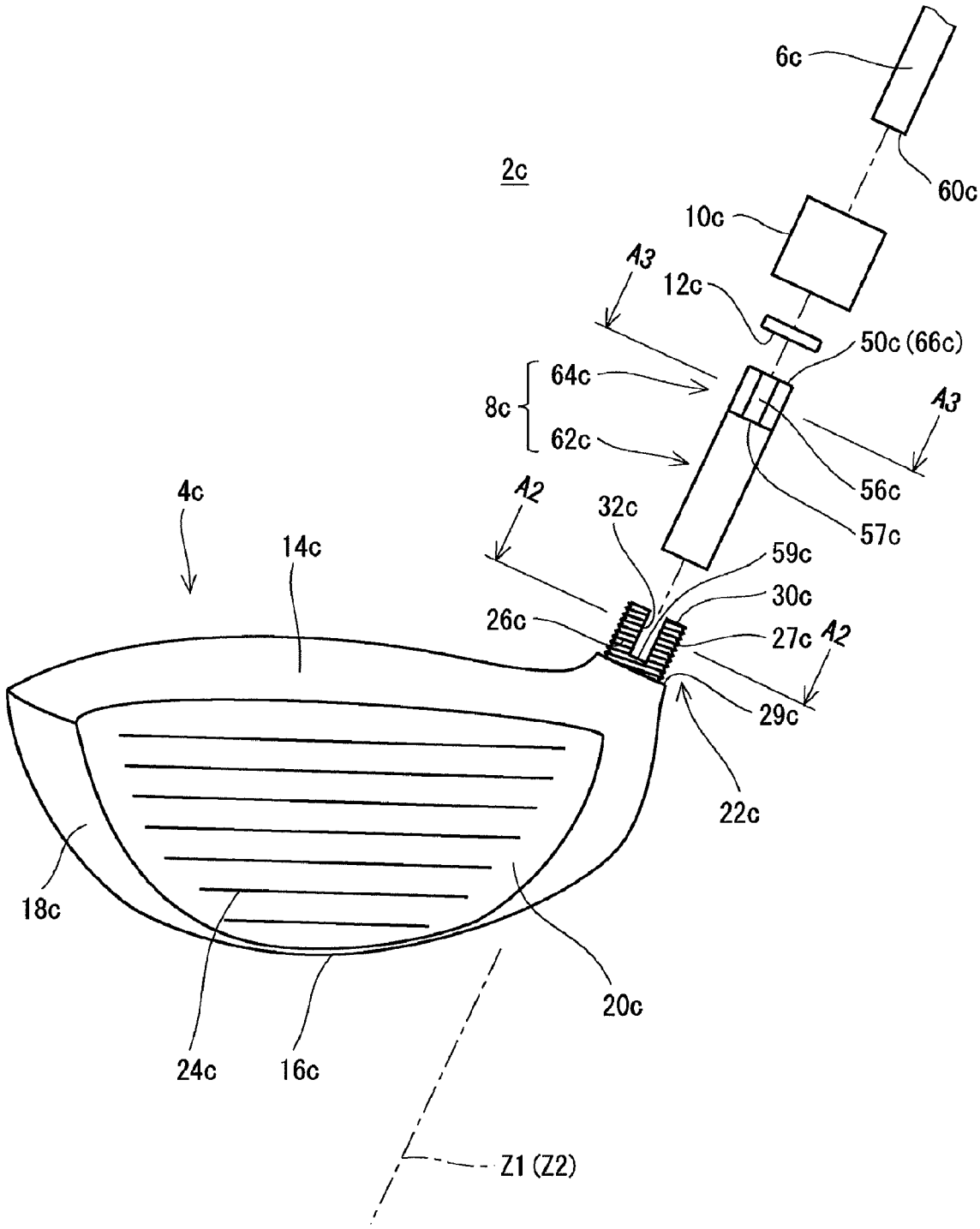
FIG. 22 is an exploded view showing the golf club in FIG. 21.

FIG. 21 is a view showing a part of a golf club 2*c* according to the comparative example 3. FIG. 22 is an exploded view showing the golf club 2*c*. The golf club 2*c* has a head 4*c* and a shaft 6*c*. The head 4*c* is attached to one of ends of the shaft 6*c*. The golf club 2*c* has an inner member 8*c*, a cap 10*c* and a washer 12*c*. The inner member 8*c*, the cap 10*c* and the washer 12*c* are members for fixing the head 4*c* to the shaft 6*c*.

The head 4*c* has a crown portion 14*c*, a sole portion 16*c*, a side portion 18*c*, a face portion 20*c* and a hosel portion 22*c*. Except for the hosel portion 22*c*, the head 4*c* is the same as the head according to the example 1.

The hosel portion 22*c* has a screw portion 26*c* and a hosel hole 28*c*. The screw portion 26*c* is provided on an upper end of the hosel portion 22*c*. The screw portion 26*c* is a male screw. The screw portion 26*c* is formed on an outer peripheral surface of the hosel portion 22*c*. The upper end of the hosel portion 22*c* is set to be a cylindrical portion 27*c*. The screw portion 26*c* is provided on an outer peripheral surface of the cylindrical portion 27*c*. A step surface 29*c* is present on a boundary between the cylindrical portion 27*c* of the hosel portion 22*c* and a non-cylindrical portion.

Figure 23:
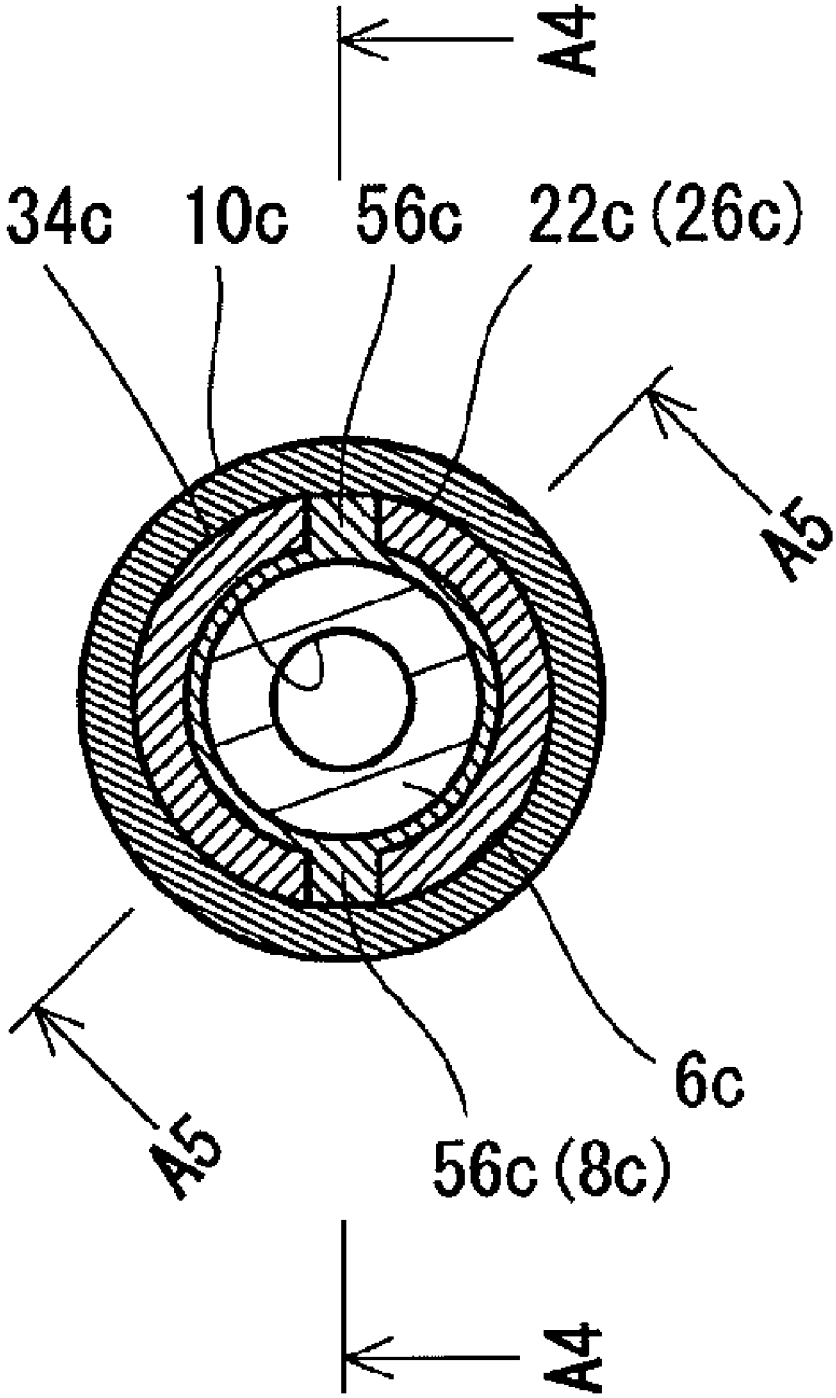
FIG. 23 is a sectional view taken along an A1-A1 line in FIG. 21.
Figure 24:
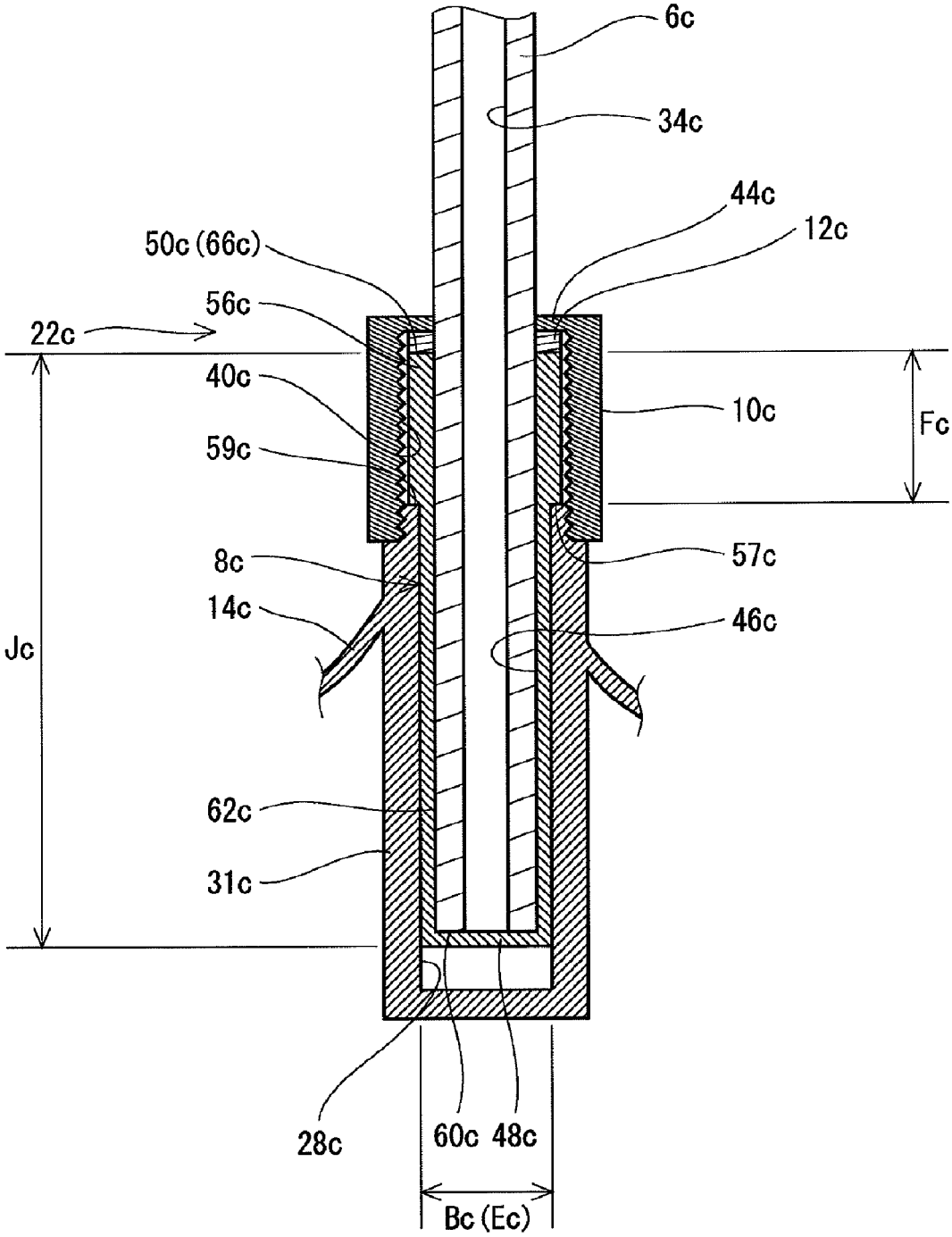
FIG. 24 is a sectional view showing the golf club taken along an A4-A4 line in FIG. 23.
Figure 25:
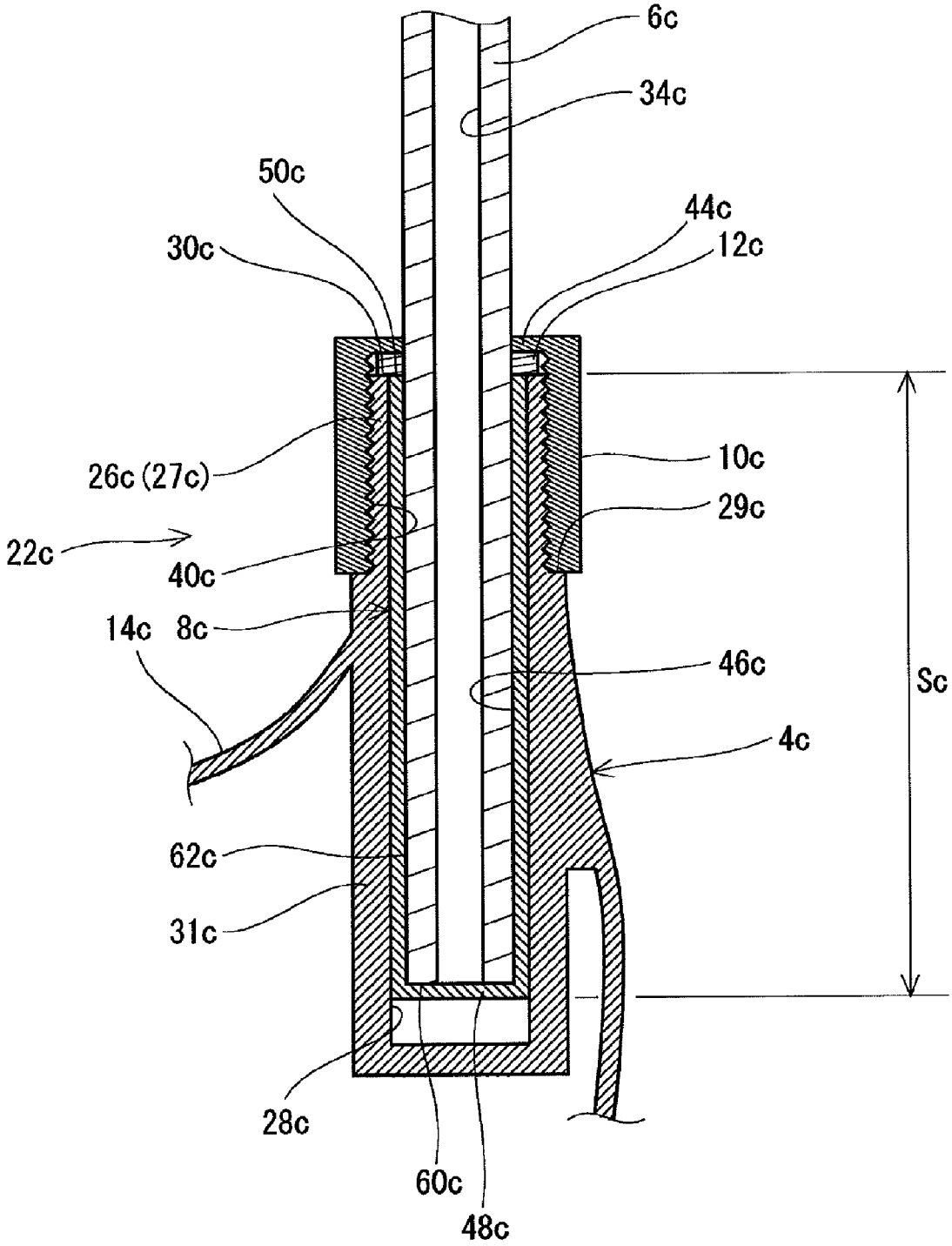
FIG. 25 is a sectional view showing the golf club taken along an A5-A5 line in FIG. 23.
Figure 26:
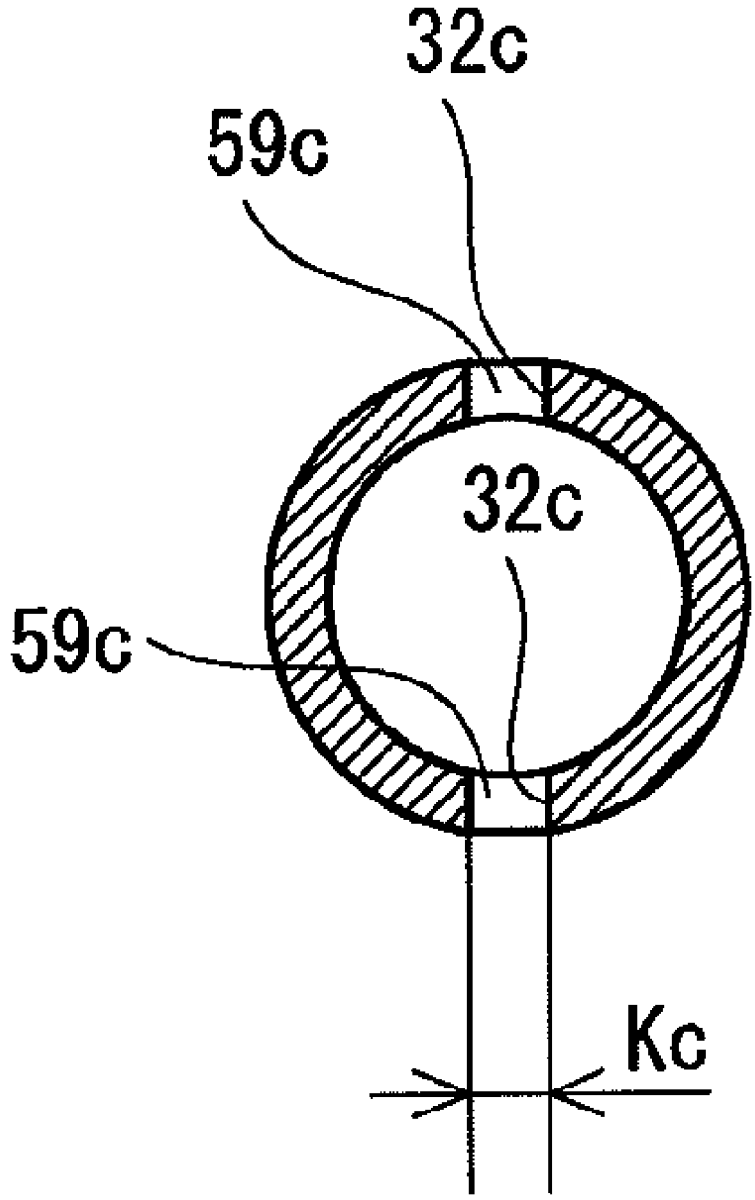
FIG. 26 is a sectional view taken along an A2-A2 line in FIG. 22.
Figure 27:
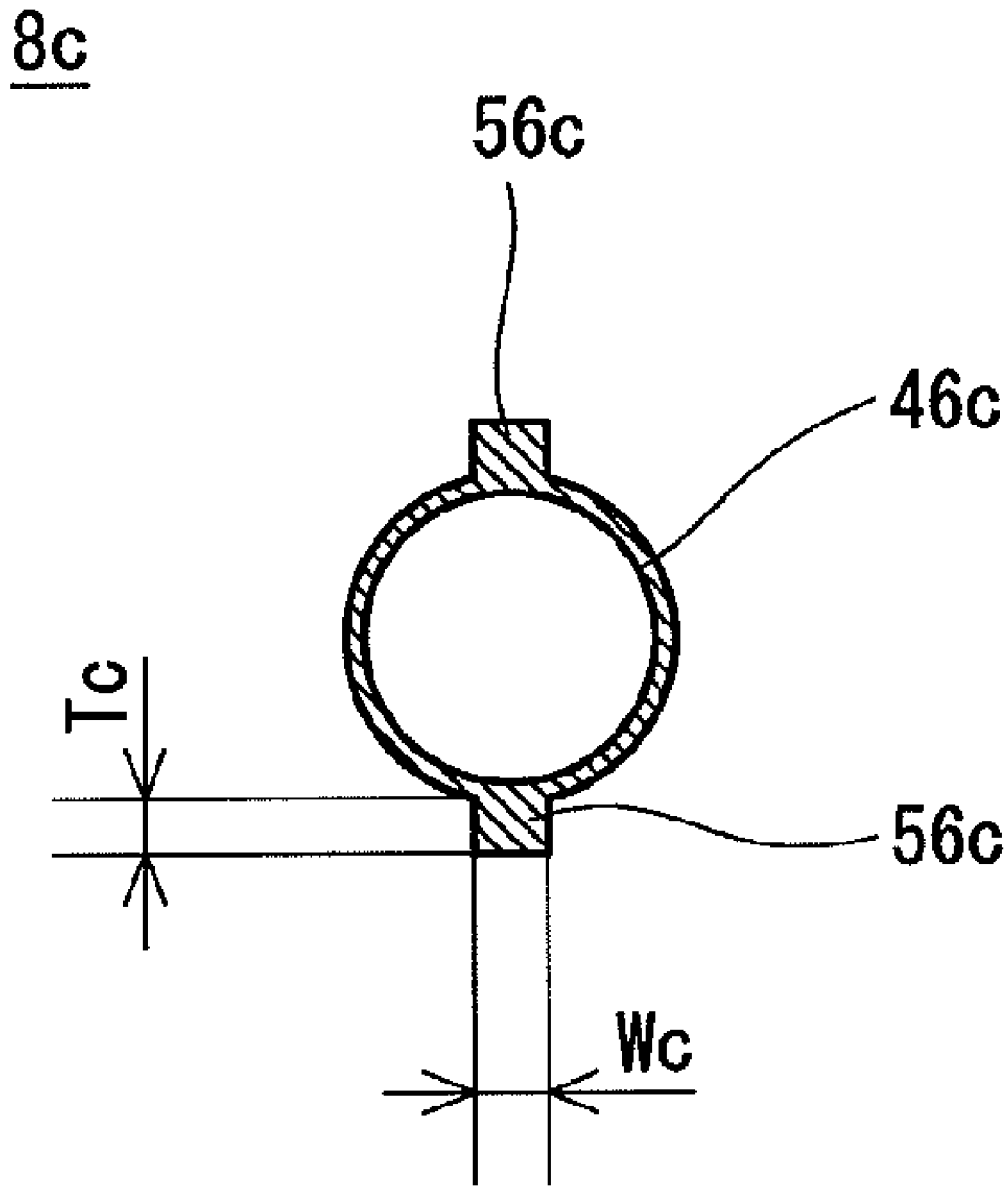
FIG. 27 is a sectional view taken along an A3-A3 line in FIG. 22.
Figure 28:
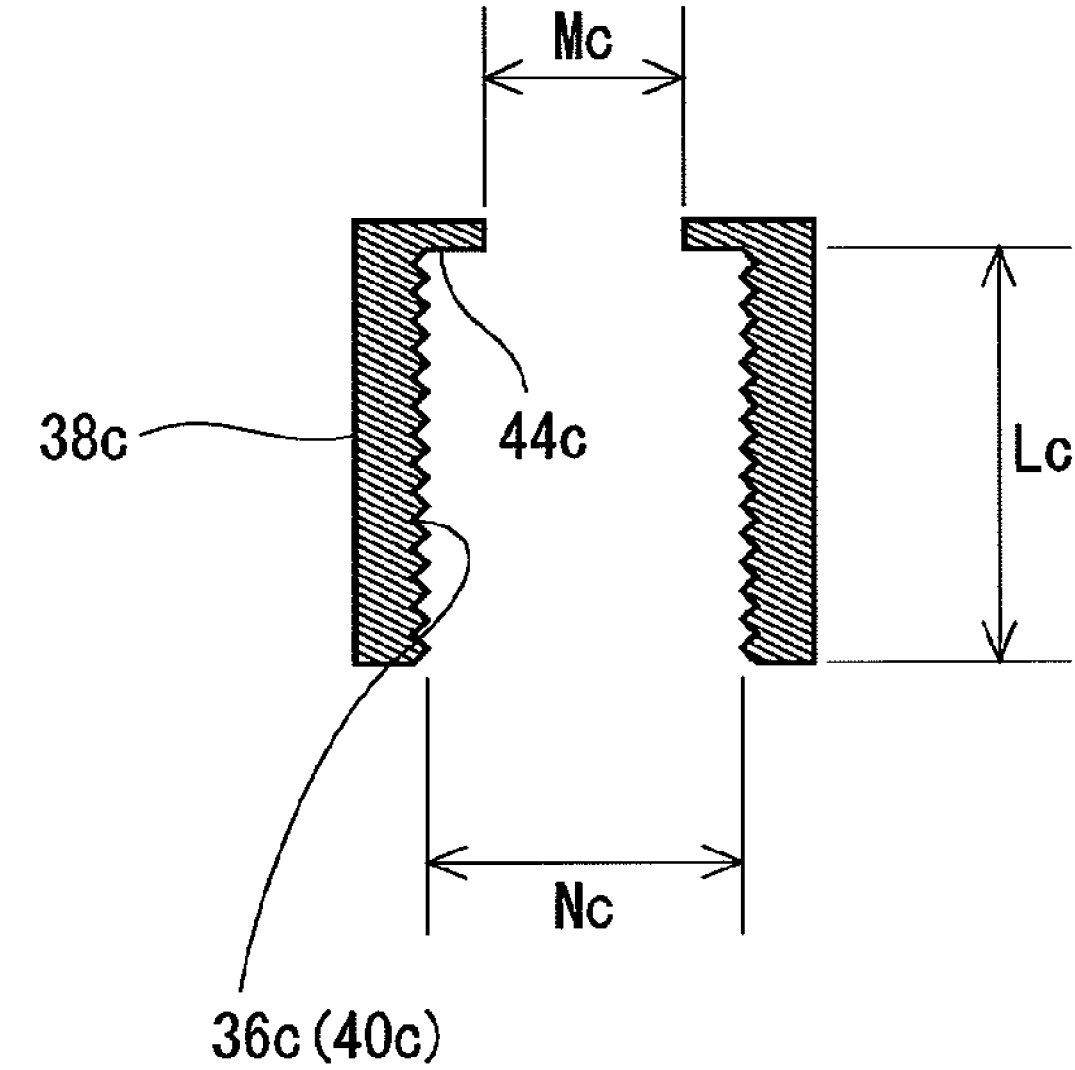
FIG. 28 is a sectional view showing a cap.
Figure 29:
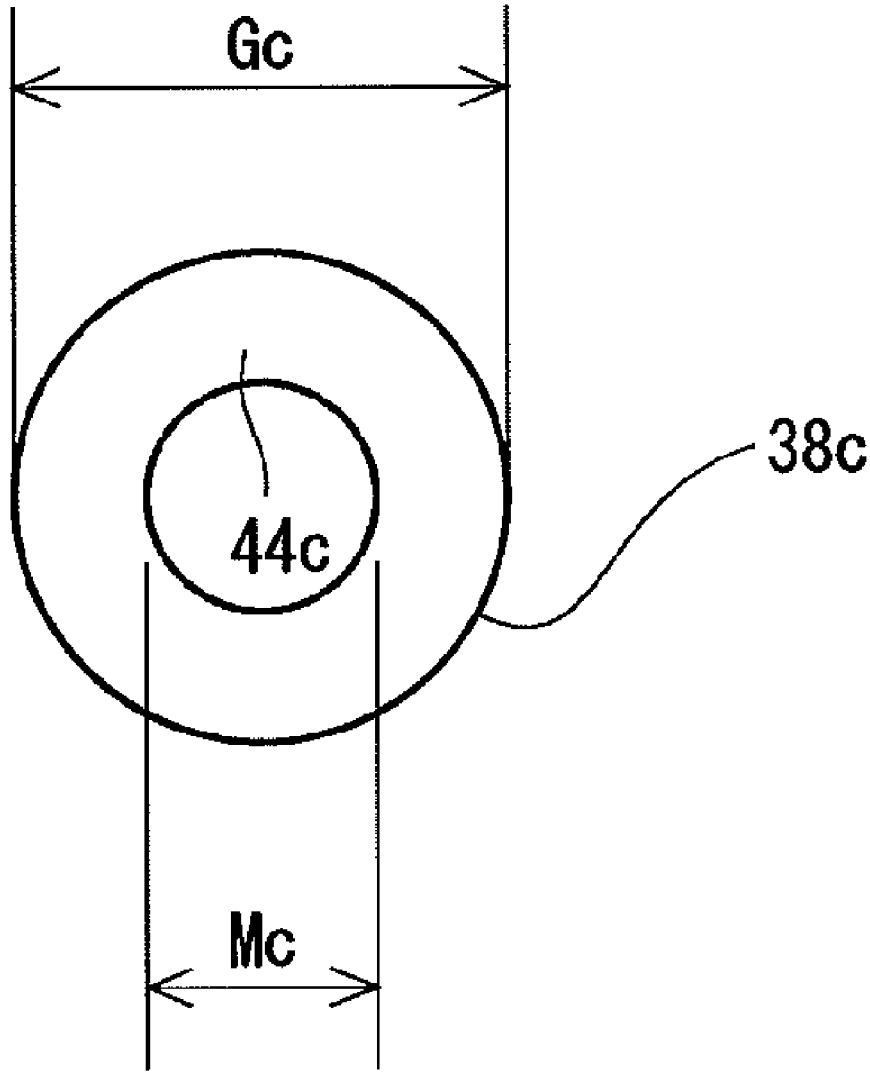
FIG. 29 is a view showing the cap seen from above.

FIG. 23 is a sectional view taken along an A1-A1 line in FIG. 21, FIG. 24 is a sectional view showing the golf club 2*c* taken along an A4-A4 line in FIG. 23, and FIG. 25 is a sectional view showing the golf club 2*c* taken along an A5-A5 line in FIG. 23. FIG. 26 is a sectional view taken along an A2-A2 line in FIG. 22. FIG. 26 is a sectional view showing the hosel portion 22*c* solely. FIG. 27 is a sectional view taken along an A3-A3 line in FIG. 22. FIG. 27 is a sectional view showing the inner member 8*c* solely. FIG. 28 is a sectional view showing the cap 10*c*. FIG. 29 is a view showing the cap 10*c* seen from above. For easy understanding of the drawings, a sectional shape of the screw portion is not taken into consideration in FIGS. 23 and 26.

As shown in FIG. 25, a part of the hosel hole 28*c* is formed by the cylindrical portion 27*c*. More specifically, an inner peripheral surface of the cylindrical portion 27*c* forms an upper end portion of the hosel hole 28*c*. Furthermore, the hosel hole 28*c* is extended downward in a direction of a shaft axis Z1. A hole forming portion 31*c* for forming the hosel hole 28*c* is provided in the head 4*c*. A sectional shape of the hosel hole 28*c* is a circle in a section in a perpendicular direction to the direction of the shaft axis Z1.

As shown in FIG. 22, the hosel portion 22*c* has a chip portion 32*c* extended downward from an upper end face 30*c* thereof. The hosel portion 22*c* is not present in the chip portion 32*c*. The chip portion 32*c* is present in only the cylindrical portion 27*c*. As shown in FIG. 26, the chip portion 32*c* is provided at a regular interval in a circumferential direction of the cylindrical portion 27*c*. The chip portion 32*c* is provided every 180 degrees in the circumferential direction of the cylindrical portion 27*c*. The chip portion 32*c* is provided in two places.

The chip portion 32*c* is extended in parallel with the shaft axis Z1. The chip portion 32*c* has a constant width. More specifically, the width of the chip portion 32*c* (a width in the circumferential direction) is equal in all positions in the direction of the shaft axis Z1.

As shown in FIGS. 24 and 25, the shaft 6*c* is set to take a tubular shape. The shaft 6*c* is set to take a cylindrical shape. A hollow portion 34*c* is present in the shaft 6*c*. The shaft 6*c* is the same as the shaft according to the example 1.

The cap 10*c* is cylindrical. An inner part of the cap 10*c* is hollow. As shown in FIG. 28, the cap 10*c* has an inner peripheral surface 36*c* and an outer peripheral surface 38*c*. The outer peripheral surface 38*c* of the cap 10*c* is a circumferential surface. A screw portion 40*c* is formed on the inner peripheral surface 36*c*. The screw portion 40*c* is a female screw. The cap 10*c* has an inward extended surface 44*c* which is extended inward from the screw portion 40*c*. The inward extended portion 44*c* is disposed above the screw portion 40*c*. The inward extended portion 44*c* is disposed on an upper end portion of the cap 10*c*. The inward extended portion 44*c* is annular. An inside diameter Mc of the inward extended portion 44*c* is smaller than an inside diameter Nc of the screw portion 40*c*. As shown in FIG. 25, the screw portion 40*c* of the cap 10*c* is coupled to a screw portion 26*c* of the hosel portion 22*c*. In other words, the screw portion 40*c* is coupled into the screw portion 26*c*. Thus, the cap 10*c* and the head 4*c* are coupled through a screw mechanism.

The washer 12*c* is a ring. An outside diameter of the washer 12*c* is almost equal to the inside diameter Nc of the cap 10*c*. An inside diameter of the washer 12*c* is almost equal to an outside diameter in a tip portion of the shaft 6*c*.

As shown in FIGS. 24 and 25, the inner member 8*c* has a shaft inserting hole 46*c*, a bottom portion 48*c*, and an engaging surface 50*c*. The engaging surface 50*c* serves as an upper end face of the inner member 8*c*. In the inner member 8*c*, the shaft inserting hole 46*c* is opened upward. The shaft inserting hole 46*c* is extended from the upper end face of the inner member 8*c* to the bottom portion 48*c*. The inner member 8*c* is wholly integrated. The integrated inner member 8*c* has a high strength.

As shown in FIGS. 24 and 25, the shaft 6*c* is inserted into the shaft inserting hole 46*c*. The shaft inserting hole 46*c* and the shaft 6*c* are fixed through bonding. In other words, an inner peripheral surface of the shaft inserting hole 46*c* is bonded to an outer peripheral surface of the shaft 6*c*. An adhesive is used for the bonding.

The engaging surface 50*c* is indirectly engaged with the inward extended portion 44*c* through the washer 12*c*. By the engagement, the inner member 8*c* is controlled to be moved upward in an axial direction with respect of the cap 10*c*. By the engagement, it is possible to prevent the inner member 8*c* from slipping out of the hosel hole 28*c*.

The whole inner member 8*c* is inserted into the hosel hole 28*c*. By the insertion into the hosel hole 28*c*, the inner member 8*c* is held on the hosel hole 28*c*. The inner member 8*c* and the hosel hole 28*c* are not bonded to each other.

The tip portion of the shaft 6*c* is inserted into the shaft inserting hole 46*c* and is positioned in the hosel hole 28*c*.

Furthermore, the inner member 8*c* has an engaging projection 56*c*. The engaging projection 56*c* is provided on an upper end portion of the inner member 8*c*. The engaging projection 56*c* is provided on an external surface of the inner member 8*c*. As shown in FIG. 27, the engaging projection 56*c* is protruded outward in a radial direction. The engaging projection 56*c* is disposed in the chip portion 32*c*. The engaging projection 56*c* is inserted into the chip portion 32*c*. The engaging projection 56*c* and the chip portion 32*c* are engaged with each other. A shape of the engaging projection 56*c* corresponds to a shape of the chip portion 32*c*. An arrangement of the engaging projection 56*c* corresponds to an arrangement of the chip portion 32*c*. In the same manner as the chip portion 32*c*, the engaging projection 56*c* is disposed at a regular interval in the circumferential direction. By the engagement of the engaging projection 56*c* and the chip portion 32*c*, a relative rotation of the hosel portion 22*c* of the head 4*c* and the inner member 8*c* (a relative rotation in the circumferential direction) is controlled.

The chip portion 32*c* and the engaging projection 56*c* also serve as a stopper for controlling an inserting length Sc (see FIG. 25) of the inner member 8*c* into the hosel hole 28*c*. More specifically, by the engagement of a lower end 57*c* of the engaging projection 56*c* and a lower end 59*c* of the chip portion 32 (see FIG. 24), the inserting length Sc of the inner member 8*c* is controlled.

As described above, the inner member 8*c* has the engaging surface 50*c*. The engaging surface 50*c* constitutes a perpendicular plane to a central axis Z2 of the inner member 8*c*. The central axis Z2 of the inner member 8*c* is coincident with the shaft axis Z1. As described above, the engaging surface 50*c* constitutes the upper end face of the inner member 8*c*. An end face 60*c* of a lower end of the shaft 6*c* abuts on the bottom portion 48*c* of the inner member 8*c*.

As shown in FIG. 22, the inner member 8*c* has a circumferential surface portion 62*c* and an engaging portion 64*c*. The circumferential surface portion 62*c* has an external surface which is a circumferential surface. The engaging portion 64*c* has an external surface on which an engaging projection 56*c* is disposed. A boundary between the circumferential surface portion 62*c* and the engaging portion 64*c* serves as the lower end 57*c* of the engaging projection 56*c*. The engaging portion 64*c* is positioned on an upper side of the circumferential surface portion 62*c*. An upper end face of the engaging portion 64*c* serves as the engaging surface 50*c*.

By the presence of the engaging surface 50*c*, the upper end face of the inner member 8*c* is provided with an outward extended surface 66*c* which is extended outward in a radial direction from the circumferential surface portion 62*c* (see FIG. 24). The outward extended surface 66*c* constitutes a part of the engaging surface 50*c*. The outward extended surface

66*c* serves as the upper end face of the engaging projection 56*c*. By the outward extended surface 66*c*, the inner member 8*c* is easily engaged with the inward extended portion 44*c*.

As shown in FIGS. 24 and 25, the inward extended portion 44*c* of the cap 10*c* is engaged with the engaging surface 50*c* of the inner member 8*c*. By the engagement, the inner member 8*c* is controlled to be moved upward with respect to the hosel hole 28*c*. By the engagement, it is possible to prevent the inner member 8*c* from slipping out of the hosel hole 28*c*.

The inward extended portion 44*c* and the engaging surface 50*c* are engaged with each other through the washer 12*c*. The inside diameter Mc of the inward extended portion 44*c* (see FIG. 28) is set to be almost equal to an outside diameter of the shaft 6*c* at the lower end of the shaft 6*c*. In other words, the inside diameter Mc is set to be a minimum within such a limit as not to interfere with the shaft 6*c*.

When the cap 10*c* and the hosel portion 22*c* are relatively rotated to insert the screw portion 40*c* into the screw portion 26*c*, the cap 10*c* is moved downward with respect to the hosel portion 22*c*. By the movement, the inward extended portion 44*c* approaches the engaging surface 50*c*. By a further insertion, the inward extended portion 44*c* presses the engaging surface 50*c* in a downward direction directly or indirectly. In the golf club 2*c*, the inward extended portion 44*c* indirectly presses the engaging surface 50*c*.

In the golf club 2*c* according to the comparative example 3, thus, the fixation of the head 4*c* and the shaft 6*c* is achieved by the screw mechanism.

The head 4*c* was formed integrally by lost-wax precision casting. A material of the head 4*c* was set to be Ti-6Al-4V. A weight of the head 4*c* was 170 g. A material of the inner member 8*c* was set to be an aluminum alloy. A weight of the inner member 8*c* was 2.0 g. A material of the cap 10*c* was set to be an aluminum alloy. A weight of the cap 10*c* was 3.0 g. A material of the washer 12*c* was set to be an aluminum alloy. A weight of the washer 12*c* was 0.1 g. They were assembled to obtain the golf club 2*c* shown in FIG. 21. "ESPRENE" manufactured by Tohritu Kasei Kohgyou Co., Ltd. was used as an adhesive for bonding the shaft 6*c* to the inner member 8*c*. In the comparative example 3, a diameter Bc of the hosel hole 28*c* (see FIG. 24) was set to be 10.0 mm. An outside diameter Ec of the circumferential surface portion 62*c* (see FIG. 24) was set to be 9.9 mm. A length Fc in the axial direction of the engaging projection 56*c* (see FIG. 24) was set to be 10.1 mm. A length in the axial direction of the chip portion 32*c* was set to be 10.0 mm. An outside diameter (a maximum diameter) of the screw portion 26*c* was set to be 14.0 mm. A length Jc in the axial direction of the inner member 8*c* (see FIG. 24) was set to be 41.0 mm. A width Wc of the engaging projection 56*c* (see FIG. 27) was set to be 2.9 mm. A thickness Tc of the engaging projection 56*c* (see FIG. 27) was set to be 1.5 mm. A width Kc of the chip portion 32*c* (see FIG. 26) was set to be 3.0 mm. An outside diameter Gc of the cap 10*c* (see FIG. 29) was set to be 17.0 mm. A length Lc in the axial direction of the cap 10*c* (see FIG. 28) was set to be 14.0 mm. The inside diameter Mc of the inward extended portion 44*c* was set to be 9.1 mm.

The comparative example 3 is different from the example 1 in respect of a mechanism for fixing the shaft to the head. As described above, in the comparative example 3, the relative rotation of the inner member 8*c* and the hosel hole 28*c* is controlled by the engagement of the chip portion 32*c* and the engaging projection 56*c*. The others are the same as in the example 1 so that the golf club 2*c* according to the comparative example 3 was obtained. The specification and evaluation results in the comparative example 3 are shown in the following Table 1.

An evaluating method is set in the following manner.

[Evaluation of Appearance]

A golf player addressed a golf club and carried out a sensory evaluation for an easiness to take a posture. The evaluation was set into five grades of one to five marks. The best easiness to address was set to be the five marks and the most difficulty to address was set to be the one mark. The greater mark implies a higher evaluation. Ten golf players having a handicap which is equal to or greater than 10 and is equal to or smaller than 30 carried out the evaluation. A mean value of the evaluation marks (figures below a decimal place are rounded off) is shown in the following Table 1.

[Evaluation of Durability]

A golf club was attached to a swing robot manufactured by MIYAMAE CO., LTD. and was caused to repetitively hit a golf ball at a head speed of 54 m/s. A hitting point was set to be a face center. An engaging portion of an inner member and a head was observed by eyes every 500 hitting operations and states of the head and the inner member were confirmed. The number of the hitting operations in the conformation of troubles (a breakage, a deformation, a crack, a damage and the like) in the engaging portion was set to be an evaluation result. The hitting operation was carried out 10000 times at a maximum. The evaluation result is shown in the following Table 1. The case in which the troubles were not confirmed after 10000 hitting operations is indicated as "10000 or more" in the following Table 1.

TABLE 1

Specification and Evaluation Result according to Example and Comparative Example

| | Example 1 | Example 2 | Example 3 | Example 4 | Example 5 | Example 6 | Comparative Example 1 | Comparative Example 2 | Comparative Example 3 |
|---|---|---|---|---|---|---|---|---|---|
| Detent Method | Engagement of Asymmetrical Recess and Projection | Engagement of Asymmetrical Recess and Projection | Engagement of Asymmetrical Recess and Projection | Engagement of Asymmetrical Recess and Projection | Engagement of Asymmetrical Recess and Projection | Engagement of Asymmetrical Recess and Projection | Engagement of Symmetrical Recess and Projection | Engagement of Symmetrical Recess and Projection | Engagement of Chip Portion and Projection |
| α (deg) | 10 | 10 | 10 | 10 | 5 | 18 | 30 | 30 | — |
| θ (deg) | 60 | 60 | 60 | 60 | 60 | 60 | 60 | 60 | — |
| α/θ | 0.17 | 0.17 | 0.17 | 0.17 | 0.08 | 0.30 | 0.50 | 0.50 | — |
| J(mm) | 2.0 | 0.5 | 1.0 | 5.0 | 2.0 | 2.0 | 2.0 | 0.5 | — |
| Appearance | 4 | 4 | 4 | 4 | 4 | 4 | 4 | 4 | 1.5 |
| Durability (Number of times) | 10000 or more | 6000 | 8000 | 10000 or more | 6000 | 10000 or more | 5500 | 3000 | 5000 |

In the comparative example 3, since the cap was present, the evaluation of the appearance was poor. In the example 4, since the distance J was great, the lower surface was fitted in the receiving surface with difficulty. For this reason, in the example 4, a productivity of a club assembly was slightly reduced. In the evaluation of the durability, troubles in the examples and the comparative examples 1 and 2 were made over the lower surface of the inner member. In the evaluation of the durability, the trouble in the comparative example 3 was made in the engaging projection 56*c*.

From the results of the Table 1, the advantages of the examples are apparent. From the results, the advantage of the present invention are apparent.

The present invention can be applied to all golf clubs, for example, a wood type golf club, an iron type golf club, a patter club and the like.

The above description is only illustrative and various changes can be made without departing from the scope of the present invention.

What is claimed is:

1. A golf club comprising a shaft, a head, an inner member and a screw member, wherein the head has a hosel portion and a receiving surface, the hosel portion has a screw portion formed on an internal surface or an external surface thereof and a hosel hole, the screw member has a through hole for causing the shaft and the inner member to penetrate therethrough, a screw portion and a downward surface, the screw portion of the screw member and the screw portion of the hosel portion are coupled to each other, the inner member has a central axis, a shaft inserting hole opened toward an upper end side thereof, a lower surface which can be engaged with the receiving surface, and an upward surface, at least a part of the inner member is inserted into the hosel hole, the shaft and the shaft inserting hole are fixed to each other through bonding and/or fitting, the lower surface of the inner member has a rotational symmetry with the central axis of the inner member set to be a rotational symmetrical axis, the lower surface of the inner member has a plurality of first surfaces and a plurality of second surfaces, the first surface and the second surface are alternately disposed in a circumferential direction, the first surface is a parallel surface with the central axis or a tilted surface which is tilted to the circumferential direction, the first surface is extended in such a direction as to enable, together with the receiving surface, a generation of a force capable of inhibiting a relative rotation of the inner member and the hosel hole which might be caused in hitting, the second surface is extended in a closer direction to the circumferential direction as compared with the first surface, the downward surface of the screw member and the upward surface of the inner member are engaged with each other directly or indirectly and the inner member is controlled to be moved upward with respect to the hosel hole by the engagement, the receiving surface and the first surface of the lower surface are engaged with each other directly or indirectly and the relative rotation is controlled by the engagement, and at least a part of the lower surface is a surface tilted to the circumferential direction.

2. The golf club according to claim 1, wherein the first surface and the second surface are divided through an edge line or a valley line and are continuously disposed each other in the circumferential direction, and when an angle in the circumferential direction which is defined by the edge lines having the closest relationship in the circumferential direction is set to be $\theta$ (degree) and an angle in the circumferential direction which is defined by the edge line and valley line having the closest relationship in the circumferential direction is set to be $\alpha$ (degree), a ratio $[\alpha/\theta]$ is lower than 0.5.

3. The golf club according to claim 2, wherein a distance in a direction of a shaft axis between an outermost point of the edge line and an outermost point of the valley line is equal to or greater than 1 mm and is equal to or smaller than 4 mm.

4. The golf club according to claim 1, wherein a distance in a direction of a shaft axis between an outermost point of the edge line and an outermost point of the valley line is equal to or greater than 1 mm and is equal to or smaller than 4 mm.

5. The golf club according to claim 1, wherein the first surfaces are tilted with respect to the circumferential direction.

6. The golf club according to claim 1, wherein all of the first surfaces are tilted at an equal angle with respect to the circumferential direction.

7. The golf club according to claim 1, wherein the second surfaces are tilted with respect to the circumferential direction.

8. The golf club according to claim 1, wherein all of the second surfaces are tilted at an equal angle with respect to the circumferential direction.

9. The golf club according to claim 1, wherein the lower surface has at least one projection, and a section of the projection takes a tapered shape.

* * * * *